US010759214B2

(12) United States Patent
Godfrey et al.

(10) Patent No.: US 10,759,214 B2
(45) Date of Patent: Sep. 1, 2020

(54) METHOD OF FORMING A SECURITY SHEET SUBSTRATE

(71) Applicant: DE LA RUE INTERNATIONAL LIMITED, Basingstoke, Hampshire (GB)

(72) Inventors: John Godfrey, London (GB); Rebecca Locke, Kingsclere (GB)

(73) Assignee: DE LA RUE INTERNATIONAL LIMITED, Hampshire (GB)

( * ) Notice: Subject to any disclaimer, the term of this patent is extended or adjusted under 35 U.S.C. 154(b) by 0 days.

(21) Appl. No.: 16/482,890

(22) PCT Filed: Jan. 31, 2018

(86) PCT No.: PCT/GB2018/050281
§ 371 (c)(1),
(2) Date: Aug. 1, 2019

(87) PCT Pub. No.: WO2018/142129
PCT Pub. Date: Aug. 9, 2018

(65) Prior Publication Data

US 2020/0009896 A1 Jan. 9, 2020

(30) Foreign Application Priority Data

Feb. 3, 2017 (GB) ..... 1701798.9

(51) Int. Cl.
*B42D 25/425* (2014.01)
*B42D 25/46* (2014.01)
(Continued)

(52) U.S. Cl.
CPC ..... *B42D 25/425* (2014.10); *B42D 25/324* (2014.10); *B42D 25/351* (2014.10);
(Continued)

(58) Field of Classification Search
CPC .. B42D 25/425; B42D 25/351; B42D 24/324; B42D 25/46; B42D 25/455;
(Continued)

(56) References Cited

U.S. PATENT DOCUMENTS 4,434,010 A 2/1984 Ash
5,059,245 A 10/1991 Phillips et al.
(Continued)

FOREIGN PATENT DOCUMENTS

AU 2015100575 A4 5/2015
EP 0 059 056 A1 9/1982
(Continued)

OTHER PUBLICATIONS

Jul. 27, 2017 Search Report issued in British Patent Application No. GB1701798.9.
(Continued)

*Primary Examiner* — Justin V Lewis
(74) *Attorney, Agent, or Firm* — Oliff PLC

(57) ABSTRACT

A method of forming a polymer substrate for a security sheet includes: providing first and second overlapping polymer layers each providing outwardly facing surfaces, and a colour shifting element positioned between the first and second polymer layers adapted to provide a first optical effect to a viewer, wherein the first polymer layer includes a region substantially transparent to visible light such that the colour shifting element is viewable through the first polymer layer, and; joining together the first and second polymer layers in order to generate a polymer substrate wherein, during the joining step, a surface relief is formed in the outwardly facing surface of the first layer, the surface relief being adapted to interact with light from the colour
(Continued)

shifting element in order to modify the first optical effect to provide a second optical effect different from the first optical effect.

22 Claims, 11 Drawing Sheets

(51) Int. Cl.

| | |
|---|---|
| ***B42D 25/455*** | (2014.01) |
| ***B42D 25/351*** | (2014.01) |
| ***B42D 25/324*** | (2014.01) |
| *B42D 25/23* | (2014.01) |
| *B42D 25/24* | (2014.01) |
| *B42D 25/328* | (2014.01) |
| *B42D 25/364* | (2014.01) |
| *B42D 25/373* | (2014.01) |
| *B42D 25/378* | (2014.01) |
| *B42D 25/435* | (2014.01) |
| *B42D 25/475* | (2014.01) |

(52) U.S. Cl.
CPC ..... *B42D 25/455* (2014.10); *B42D 25/46* (2014.10); *B42D 25/23* (2014.10); *B42D 25/24* (2014.10); *B42D 25/328* (2014.10); *B42D 25/364* (2014.10); *B42D 25/373* (2014.10); *B42D 25/378* (2014.10); *B42D 25/435* (2014.10); *B42D 25/475* (2014.10)

(58) Field of Classification Search
CPC .. B42D 25/475; B42D 25/373; B42D 25/328; B42D 25/24; B42D 25/364; B42D 25/23; B42D 25/435
USPC ..... 283/67, 70, 72, 74, 94, 98, 901
See application file for complete search history.

(56) References Cited

U.S. PATENT DOCUMENTS

| | | | | |
|---|---|---|---|---|
| 5,084,351 | A | 1/1992 | Philips et al. | |
| 5,135,812 | A | 8/1992 | Phillips et al. | |
| 5,171,363 | A | 12/1992 | Phillips et al. | |
| 5,571,624 | A | 11/1996 | Phillips et al. | |
| 8,124,217 | B2 | 2/2012 | Phillips et al. | |
| 9,964,674 | B2 | 5/2018 | Patel et al. | |
| 2004/0169791 | A1 | 9/2004 | Nilsen et al. | |
| 2008/0018965 | A1 | 1/2008 | Phillips et al. | |
| 2008/0278816 | A1 | 11/2008 | Phillips et al. | |
| 2010/0196587 | A1 | 8/2010 | Keller | |
| 2010/0254015 | A1 | 10/2010 | Booyens et al. | |
| 2010/0270379 | A1 | 10/2010 | Lister et al. | |
| 2011/0095518 | A1 | 4/2011 | Hoffmuller et al. | |
| 2012/0193905 | A1 | 8/2012 | Schilling et al. | |
| 2014/0103632 | A1 | 4/2014 | Camus et al. | |
| 2015/0352887 | A1* | 12/2015 | Holmes ..... | B42D 25/29 283/91 |
| 2016/0257019 | A1 | 9/2016 | Baist | |

FOREIGN PATENT DOCUMENTS

| | | | |
|---|---|---|---|
| EP | 0 341 002 | A2 | 11/1989 |
| EP | 0 668 329 | A2 | 8/1995 |
| EP | 0 741 170 | A1 | 11/1996 |
| EP | 0 860 298 | A2 | 8/1998 |
| EP | 1 398 174 | A1 | 3/2004 |
| EP | 2 161 598 | A2 | 3/2010 |
| JP | 2011-173379 | A | 9/2011 |
| WO | 83/00659 | A1 | 3/1983 |
| WO | 95/10419 | A1 | 4/1995 |
| WO | 95/10420 | A1 | 4/1995 |
| WO | 95/17475 | A1 | 6/1995 |
| WO | 00/12634 | A1 | 3/2000 |
| WO | 00/39391 | A1 | 7/2000 |
| WO | 03/054297 | A2 | 7/2003 |
| WO | 03/095188 | A2 | 11/2003 |
| WO | 2004/030928 | A1 | 4/2004 |
| WO | 2009/056354 | A1 | 5/2009 |
| WO | 2009/056359 | A2 | 5/2009 |
| WO | 2009/066048 | A1 | 5/2009 |
| WO | 2013/017865 | A1 | 2/2013 |
| WO | 2013/022699 | A1 | 2/2013 |
| WO | 2013/064268 | A1 | 5/2013 |
| WO | 2017/009619 | A1 | 1/2017 |

OTHER PUBLICATIONS

Jun. 15, 2018 Search Report issued in International Patent Application No. PCT/GB2018/050281.
Jul. 27, 2017 Search Report issued in British Patent Application No. GB1701796.3.
Apr. 24, 2018 Search Report issued in International Patent Application No. PCT/GB2018/050280.
Jul. 27, 2017 Search Report issued in British Patent Application No. GB1701795.5.
May 9, 2018 Search Report issued in International Patent Application No. PCT/GB2018/050279.
U.S. Appl. No. 16/482,918, filed Aug. 1, 2019 in the name of Locke et al.
U.S. Appl. No. 16/482,936, filed Aug. 1, 2019 in the name of Godfrey et al.
Jun. 15, 2018 Written Opinion of the International Searching Authority issued in International Patent Application No. PCT/GB2018/050281.
Apr. 24, 2018 Written Opinion of the International Searching Authority issued in International Patent Application No. PCT/GB2018/050280.
May 9, 2018 Written Opinion of the International Searching Authority issued in International Patent Application No. PCT/GB2018/050279.
Feb. 26, 2020 Office Action Issued in U.S. Appl. No. 16/482,936.
Jan. 9, 2020 Office Action issued in U.S. Appl. No. 16/482,918.
May 6, 2020 Office Action issued in British Patent Application No. 1701795.5.

* cited by examiner

METHOD OF FORMING A SECURITY SHEET SUBSTRATE

FIELD OF THE INVENTION

The present invention relates to a method of forming a substrate for a security sheet, in particular where the substrate comprises a security device. The invention has particular application for security sheets which are documents of value, such as passports, driving licenses and identity cards.

BACKGROUND TO THE INVENTION

To prevent counterfeiting and to enable authenticity to be checked, security sheets such as passport security pages, driving licenses and identify cards are typically provided with one or more security devices which are difficult or impossible to replicate with commonly available means such as photocopiers, scanners or commercial printers.

One well known type of security device is one which uses a colour shifting element to produce an optically variable effect that is difficult to counterfeit. Such a colour shifting element generates a coloured appearance which changes dependent on the viewing angle. Examples of known colour shifting structures include photonic crystals, liquid crystals, interference pigments, pearlescent pigments, structured interference materials or thin film interference structures including Bragg stacks.

It is also known in the art that the optical effect produced by a colour shifting element can be modified by introducing a film comprising a surface relief over the colour shifting element, wherein the surface relief modifies the angle of light incident to, and reflected from, the colour shifting element so as to provide a different optical effect to the viewer. For example, such an additional "light control" layer may produce colour shifting effects which are visible closer to a normal angle of viewing with respect to the device, and may enable more colours to be viewed on tilting the device as compared to the colour shifting element in isolation. WO2009/066048 describes the combination of a colour shifting element with such a "light control" layer.

The optical effect provided by a combination of a colour shifting element and such a "light control" layer enables a security device to be created that exhibits a memorable effect to a viewer that is easy to authenticate and yet difficult to counterfeit. Such a security device may be incorporated into a security sheet, typically by adhering the security device to an outer layer of the security sheet or by partially embedding the security device as a security thread within the security sheet in order to increase the security of the security sheet.

However, the process of manufacturing a plurality of such security devices to then incorporate onto a security sheet is time consuming and inefficient. Furthermore, by adhering the security device to a security sheet, the security device is vulnerable to damage or tampering.

SUMMARY OF THE INVENTION

In accordance with a first aspect of the invention there is provided a method of forming a polymer substrate for a security sheet, comprising: providing first and second overlapping polymer layers each providing outwardly facing surfaces, and a colour shifting element positioned between the first and second polymer layers adapted to provide a first optical effect to a viewer, wherein the first polymer layer comprises a region substantially transparent to visible light such that the colour shifting element is viewable through the first polymer layer, and; joining together the first and second polymer layers in order to generate a polymer substrate wherein, during the joining step, a surface relief is formed in the outwardly facing surface of the first layer, the surface relief being adapted to interact with light from the colour shifting element in order to modify the first optical effect to provide a second optical effect different from the first optical effect.

The method of the first aspect of the invention overcomes the problems outlined above by forming a polymer substrate for a security sheet having a security device already integrally formed within it, with the security device being defined by the colour shifting element and the surface relief. Furthermore, the security device is formed at substantially the same time (i.e. substantially simultaneously) as the formation of the substrate for the security sheet. The method therefore overcomes the problems outlined above in a number of ways: for example it significantly reduces the requirement to manufacture separate security devices to then be incorporated with already formed substrates, and furthermore the security device is integrated within the substrate itself, which means it is less prone to damage or tampering.

It is envisaged that a plurality of such polymer substrates formed by the first aspect of the invention may be provided to a security sheet manufacturer who will then process each substrate to generate the finished security sheets. Such processing may comprise the addition of personal information for example. Advantageously the processing of a polymer substrate to form the final security sheet will be made more efficient as the substrate already comprises a security device comprising the colour shifting element and the surface relief.

The expression "colour shifting element" is used here to refer to any material which can selectively reflect or transmit incident light to create an optically variable effect, in particular an angularly dependent coloured reflection or transmission. Examples of such a colour shifting element include photonic crystals, liquid crystals, interference pigments, pearlescent pigments, structured interference materials or thin film interference structures including Bragg stacks. A particularly suitable material for the colour shifting element is a liquid crystal film.

The expression "surface relief" is used to refer to a non-planar part of the outwardly facing surface of the first polymer layer. The surface relief typically has a plurality of facets angled with respect to the surface of the first polymer layer so as to define a plurality of elevations and depressions. Light from the colour shifting element is refracted at the interface between the angled facets of the surface relief and the air in a different manner to how it would be refracted at the interface between a planar surface of the first polymer layer and the air, and in this way the surface relief interacts with light from the colour shifting element and modifies the first optical effect. The surface relief is formed in the outwardly facing surface of the first polymer layer, and is therefore formed in an outwardly facing surface of the polymer substrate for the security sheet. The surface relief typically has a pitch (e.g. the distance between adjacent elevations) in the range of 1-100 μm, more preferably 5-70 μm, and structure depth (e.g. the height of an elevation) in the range of 1-100 μm, more preferably 5-40 μm.

The first polymer layer comprises a region substantially transparent to visible light such that the colour shifting element is visible through the first polymer layer (this region may be substantially translucent). This ensures that the second optical effect due to the interaction of light from the colour shifting element with the surface relief is exhibited to (i.e. can be seen by) a viewer. The surface relief can be formed so as to substantially completely cover the colour shifting element. However, in some examples the surface relief may be formed over a part of the colour shifting element such that different optical effects are provided to the viewer, typically exhibited as regions of different colour. For example, the part of the transparent region that is planar (i.e. where no surface relief was formed) will exhibit the first optical effect (typically a red to green colour shift), and the surface relief will exhibit the second optical effect (typically a red to green to blue colour shift).

Here the expression "overlapping" includes partially overlapping and fully overlapping. Typically the polymer layers have substantially the same cross sectional area and are provided in a fully overlapping manner such that they are aligned with each other in a direction normal to the polymer layers.

The colour shifting element and the surface relief may form a security device in its own right, such that each polymer substrate comprises the same security device which exhibits a memorable effect to a viewer that is easy to authenticate and yet difficult to counterfeit. However, a further benefit of the invention is that the surface relief of the substrate may be selectively modified in order to produce unique, "personalized" finished security sheets. As described above, the surface relief is adapted to interact with light from the colour shifting element in order to modify the first optical effect provided by the colour shifting element to provide a second optical effect. Typically, at least at one viewing angle, the first optical effect exhibits a first colour, and the second optical effect exhibits a second colour different from the first colour. The surface relief may be selectively modified such that a part of the surface relief becomes "non-functional" and the optical effect exhibited by the modified part is same as the first optical effect. This may be done, for example, by the addition of a resin so as to form a planar surface at that part of the surface relief (the planar surface being substantially parallel to the plane of the colour shifting element), or by removal of a part of the surface relief. This advantageously allows selective modification of the surface relief in order to define indicia which will be revealed to the viewer upon tilting of the substrate due to different colours being exhibited by the modified and unmodified parts of the surface relief.

Here "tilting" is used to mean a change in viewing angle of the substrate by tilting the substrate about an axis in the plane of the substrate. Typically the change in viewing angle is from a normal angle of viewing to a non-normal angle of viewing.

Therefore, if a plurality of polymer substrates formed by the first aspect of the invention are provided to a security sheet manufacturer, each substrate may be individually modified so as to define indicia unique to that security sheet (for example biometric data relating to a holder to a passport). This ability to efficiently generate unique personalized security sheets using polymer substrates formed by the present invention is particularly beneficial.

If the surface relief is selectively modified such that the modified "non-functional" part(s) of the surface relief are on a scale that is not perceptible (i.e. resolvable) to the naked human eye (typically less than 150 μm, preferably less than 100 μm and even more preferably less than 70 μm), then the resulting optical effect exhibited to the viewer by the modified surface relief will be a combination of the first and second optical effects. This is typically experienced as a "mixing" of the colours produced by the first and second optical effects exhibited by adjacent modified and unmodified parts of the surface relief. Dependent on the ratio of the modified and non-modified part(s) of the surface relief, different colours may be seen upon tilting of the security sheet due to the combination of the first and second optical effects. Therefore modifying the surface relief of a security sheet substrate in such a manner advantageously provides an alternative or complimentary means of producing personalized, unique security sheets.

Typically, the method further comprises providing at least one internal polymer layer positioned between and overlapping with the first and second polymer layers, wherein each of any internal layer positioned between the colour shifting element and the first polymer layer comprise at least a region substantially transparent to visible light such that the colour shifting element is viewable through the surface relief. In such a case the first and second polymer layers and the at least one internal layer are provided as a "stack" before being joined together. The term "overlapping" has the same meaning as outlined above, and typically the polymer layers of such a stack are provided in a fully overlapping manner such that they are substantially aligned in a direction normal to the polymer sheets.

In the case where at least one internal polymer layer is provided, the colour shifting element is typically provided on an internal layer. Here the term "on" is intended to mean that the internal layer provides support for the colour shifting element. Typically the colour shifting element is in contact with a surface of the internal layer, although this is not necessarily the case.

In the case where at least one internal polymer layer is provided, the surface relief may be formed in the outwardly facing surface of the first polymer layer only, or additionally extend through at least one internal layer. However, the surface relief is formed "above" the colour shifting element, such that the colour shifting element is located between the second polymer layer and the surface relief.

The joining step may comprise a lamination process, and may typically comprise applying at least one of heat and pressure to the overlapping polymer layers. The application of heat means that each of the overlapping polymer layers becomes at least softened or semi-molten (i.e. a liquid of relatively high viscosity) such that the polymer flows and mixes together across the interfaces between the layers, thereby joining them together. Other means of joining the polymer layers are envisaged however, for example through the use of adhesive.

The joining step may comprise applying pressure to the overlapping polymer layers by means of opposing pressure plates and an embossing structure corresponding to the surface relief, wherein during the joining step the embossing structure is in communication with the outwardly facing surface of the first polymer layer. The embossing structure typically comprises a plurality of elevations and depressions, wherein the elevations of the embossing structure correspond to depressions of the surface relief formed in the substrate, and the depressions of the embossing structure correspond to elevations of the surface relief formed in the substrate. In this way the embossing structure is a "negative" of the desired surface relief. Therefore, through the use of such pressure plates and an embossing structure, the joining together of the polymer layers and the formation of the surface relief in the outwardly facing surface of the first outer layer are performed substantially simultaneously.

The embossing structure may be provided separately to the pressure plates, for example on a support surface provided between the uppermost pressure plate and the outwardly facing surface of the first polymer layer, such that through actuation of the pressure plates during the joining step, the embossing structure is brought into contact with the first polymer layer.

Preferably the opposing pressure plates are adapted to provide heat to the overlapping polymer layers. For example, the opposing pressure plates may comprise heating elements.

The surface relief is preferably formed by an embossing process, and may take a number of different forms that may each provide a different optical effect to a viewer. For example, the surface relief may comprise a microprismatic structure, wherein the microprismatic structure comprises a plurality of microprisms. Such a microprismatic structure may comprise an array of linear microprisms, wherein typically the long axes of the microprisms within an array are parallel to each other. Such a microprismatic structure typically has a pitch (e.g. the width of an individual microprism) in the range of 1-100 μm, more preferably 5-70 μm, and structure depth (e.g. the height of an individual microprism) in the range of 1-100 μm, more preferably 5-40 μm.

Such a microprismatic structure may comprise two or more arrays of linear microprisms, wherein the long axes of one array are angularly offset from the axes of the other array. The second optical effect provided by the interaction of the array of microprisms with light from the colour shifting element is most readily observed when the microprisms are viewed in a direction perpendicular to the long axes of the microprisms. Therefore, a microprismatic structure comprising two or more arrays of microprisms offset from each other allows for a second optical effect that is readily observed when the substrate is rotated within its plane (i.e. viewed at different azimuthal angles).

The microprisms of a microprismatic structure may have a symmetrical or asymmetrical structure. The microprisms of a microprismatic structure may have a repeating faceted structure.

Such a microprismatic structure may be a one-dimensional microprismatic structure, meaning that it is comprised of a plurality of one-dimensional microprisms. The term "one-dimensional" is used here to mean that the second optical effect produced by an individual microprism within the structure is significantly stronger (i.e. more noticeable to a user) in one direction of viewing (i.e. in a direction perpendicular to a long axis of the microprism).

The surface relief may alternatively or additionally comprise a microprismatic array comprising a two-dimensional microprismatic structure, meaning that it is comprised of a plurality of two-dimensional microprisms. Here there term "two-dimensional" is used to mean that the second optical effect produced by an individual microprism is readily noticeable to a viewer in more than one direction of viewing. Such a two-dimensional microprismatic structure may comprise a pyramidal or corner cube structure for example.

Alternatively or in addition to a microprismatic structure, the surface relief may comprise a lenticular array having a curved surface structure.

Preferably, at least one of the polymer layers comprises a plastic material, preferably polycarbonate, polyethylene terephthalate (PET) or polyethylene terephthalate glycol-modified (PETG). The use of a plastic material advantageously provides a rigid or at least semi-rigid substrate for a security sheet, such that the finished security sheet is resistant to damage and wear.

The colour shifting element may be viewed in either reflection or transmission. In the case where it is to be viewed in reflection, it is preferable to provide an absorbing element positioned between the first and second polymer layers and on a distal side of the colour shifting element with respect to the first polymer layer, the absorbing element being adapted to at least partially absorb light. This is particularly advantageous when the colour shifting element is partially transparent (such as a layer of a cholesteric liquid crystal material). Such a colour shifting element only reflects certain wavelengths of light dependent upon its structure, with the remainder of the light incident upon the colour shifting element being transmitted through the colour shifting element and impinging upon the absorbing element. The absorbing element is sufficiently opaque to absorb the wavelengths of light that are not reflected by the colour shifting element such that the light reflected off the colour shifting element dominates the optical effect exhibited to the viewer.

Preferably, the absorbing element has black or dark areas. However, this is not essential so long as the absorbing element at least partially absorbs light transmitted through the colour shifting element such that the light reflected off the colour shifting element dominates. The absorbing element may typically comprise a substantially opaque polymer or a substantially opaque ink.

The absorbing element is positioned on a distal side of the colour shifting element with respect to the surface relief, and there are a number of ways in which this can be arranged, especially when at least one internal layer is provided. For example, the colour shifting element and the absorbing element may be positioned on the same internal layer. In such a case, they may be positioned on the same surface of the internal layer, or on (preferably in contact with) opposing surfaces of the internal layer. In the case where the colour shifting element and the absorbing element are positioned on the same surface of the internal layer, the colour shifting element is positioned on top of the absorbing element such that it is positioned between the absorbing element and the surface relief. However, both the colour shifting element and the absorbing element are supported by the same internal layer.

As another example, the colour shifting element and the absorbing element may be positioned on (preferably in contact with) separate internal layers.

The colour shifting element and the absorbing element may be provided in register. The term "in register" is used to mean that the colour shifting element and the absorbing element are substantially aligned with each other in a direction normal to the polymer layers (i.e. overlapping) and are in the same relative positions on a plurality of substrates for security sheets.

Advantageously, the absorbing element may define indicia. As described above, the absorbing element absorbs wavelengths of light that are transmitted through the colour shifting element such that the light reflected off the colour shifting element dominates. Therefore, where the absorbing element defines indicia, only part of the colour shifting element will be positioned between an absorbing element and the surface relief, with that part of the colour shifting element corresponding to the indicia of the absorbing element. Therefore, when viewed in reflection, the part of the colour shifting element corresponding to the indicia will be most readily observable, providing a memorable effect to the viewer. Where a substantially opaque colour shifting element is used (such as an optically variable pigment), the colour shifting element itself may define indicia.

In the case where at least one internal polymer layer is provided, the method may comprise providing a substantially opaque internal layer positioned between the colour shifting element and the first polymer layer, the substantially opaque internal layer comprising a window region substantially transparent to visible light through which the colour shifting element is viewable. The window region and the colour shifting element are typically in register. The term "in register" has the same meaning as above, in that the colour shifting element and the window region are substantially aligned with each other in a direction normal to the polymer layers and are in the same relative positions on a plurality of substrates for security sheets. The window region may define a shape, such that the colour shifting element is viewed as a shape defined by the window region. Such a shaped window advantageously improves security of the substrate.

In some examples, the second polymer layer comprises a region substantially transparent to visible light such that the colour shifting element is viewable through the second polymer layer and; during the joining step, a second surface relief is formed in the outwardly facing surface of the second layer, the second surface relief being adapted to interact with light from the colour shifting element in order to modify the first optical effect. The formation of such a second surface relief is particularly beneficial when the colour shifting element is substantially opaque to visible light (for example an optically variable pigment). In such a scenario, the viewer will see optical effects from both sides of the polymer substrate due to the modification of light reflected from the colour shifting element by the surface relief in the first outwardly facing surface, and the second surface relief. Such a polymer substrate comprising two surface reliefs in opposing outwardly facing surfaces advantageously provides a memorable effect to a user, and enhanced security.

In the case where the colour shifting element is partially transparent (i.e. transmits at least a proportion of visible light incident upon it), when providing a second surface relief in the outwardly facing surface of the second polymer layer, it is preferable to provide a second colour shifting element positioned on a distal side of the first colour shifting element with respect to the first polymer layer if the optical effects of the polymer substrate are desired to be exhibited in reflection. This reduces the effect of light transmitted through the colour shifting elements on the optical effects exhibited to a viewer through the first and second surface reliefs. It is further preferable to provide an absorbing element between the first and second colour shifting elements in order to substantially absorb light transmitted through the colour shifting elements. Such an absorbing element may beneficially define indicia.

The surface reliefs may overlap each other, typically in a fully overlapping manner. In other words, when the surface reliefs fully overlap they are aligned in a direction normal to the first and second polymer layers. Alternatively, the surface reliefs may be offset from each other (i.e. there is no overlap between the surface reliefs).

The second surface relief is advantageously formed during the joining step. In other words the second surface relief is formed substantially simultaneously with the formation of the polymer substrate itself. The second surface relief is preferably formed by an embossing process, and may take a number of different forms that may each provide a different optical effect to a viewer, as described above in relation to the surface relief formed in the first outwardly facing surface. For example, the second surface relief may comprise a microprismatic structure, typically a plurality of microprisms. The microprismatic structure may comprise an array of linear microprisms. The microprismatic structure may comprise two or more arrays of linear microprisms, wherein the long axes of one array are angularly offset from the axes of the other array. The microprisms may have an asymmetrical and/or repeating faceted structure. The microprismatic structure may be a one-dimensional microprismatic structure or a two-dimensional microprismatic structure such as a pyramidal structure. The second surface relief may comprise a lenticular array having a curved surface structure. The second surface relief typically has a pitch (e.g. the distance between adjacent elevations) in the range of 1-100 μm, more preferably 5-70 μm, and structure depth (e.g. the height of an elevation) in the range of 1-100 μm, more preferably 5-40 μm.

The second polymer layer may comprise a viewing region substantially transparent to visible light. Such a viewing region may be translucent. Typically, such a viewing region has a planar form such that it does not interact with light from the colour shifting element of the polymer substrate (either when one, or more than one, colour shifting element is provided). Such a viewing region advantageously provides a different optical effect to a viewer when they view the second outwardly facing surface of the polymer substrate as opposed to the first outwardly facing surface. The surface relief formed in the outwardly facing surface of the first polymer layer and the viewing region may overlap each other, or they may be offset from each other as in the case where two surface reliefs are provided.

In accordance with a second aspect of the invention there is provided a method of forming a security sheet, comprising: forming a polymer substrate according to the method of any of the first aspect of the invention, and; processing the polymer substrate in order to form the security sheet. As outlined above, a polymer substrate formed by the first aspect of the invention may be provided to a security sheet manufacturer who will then process the substrate to generate the finished security sheet. Such processing may comprise the addition of personal information, for example by laser marking as is known in the art. Advantageously the processing of the polymer substrate to form the final security sheet will be made more efficient as the substrate already comprises a security device comprising the colour shifting element and the light control layer.

The processing may comprise selectively modifying a part of the surface relief formed in the outwardly facing surface of the first polymer layer such that the modified part of the surface relief provides a different optical effect from the second optical effect. Typically the modified part of the surface relief exhibits the first optical effect (i.e. the modified part of the surface relief is "non-functional"). As described above, such selective modification of the surface relief advantageously allows indicia to be formed in the surface relief that will be exhibited to a viewer upon tilting of the security sheet. Alternatively or in addition, such modification may provide colour "mixing". As a result, personalized unique security sheets may be produced that enhance security. The selective modification may be performed by introducing resin to the surface relief, and/or by removing at least a part of the surface relief. The resin may be introduced using digital printing, and the removing may be performed by laser ablation or through thermal conduction with an applied member such as a linear or rotary embossing die in a so-called "hot-embossing" process. In both instances, the modification may be carried out with high spatial accuracy in order to define complex, difficult to counterfeit indicia. Such indicia may define biometric data (such as a portrait) relating to the holder of the security sheet.

In the case where a second surface relief is formed in the outwardly facing surface of the second layer, the processing step may comprise selectively modifying a part of the second surface relief. The second surface relief may be modified in a substantially identical or substantially different manner to the first surface relief.

In accordance with a third aspect of the invention there is provided a polymer substrate for a security sheet, the polymer substrate comprising: a plurality of overlapping, substantially self-supporting polymer layers joined together, wherein the plurality of polymer layers comprises first and second outer layers each providing outwardly facing surfaces that define outwardly facing surfaces of the polymer substrate, and at least one internal layer positioned between the first and second outer layers, wherein the at least one internal layer comprises a colour shifting element adapted to provide a first optical effect to a viewer; wherein the first outer layer and each of any internal layer positioned between the colour shifting element and the first outer layer comprise at least a region substantially transparent to visible light such that the colour shifting element is visible through a surface relief provided in the outwardly facing surface of the first outer layer, the surface relief being adapted to interact with light from the colour shifting element in order to modify the first optical effect to provide a second optical effect different from the first optical effect.

Advantageously, it is envisaged that a plurality of such polymer substrates formed by the third aspect of the invention may be provided to a security sheet manufacturer who will then process each substrate to generate finished security sheets. Such processing may comprise the addition of personal information for example. Advantageously the processing of a polymer substrate to form the final security sheet will be made more efficient as the substrate already comprises a security device comprising the colour shifting element and the surface relief.

The expression "colour shifting element" is used here to refer to any material which can selectively reflect or transmit incident light to create an optically variable effect, in particular an angularly dependent coloured reflection or transmission. Examples of such a colour shifting element include photonic crystals, liquid crystals, interference pigments, pearlescent pigments, structured interference materials or thin film interference structures including Bragg stacks. A particularly suitable material for the colour shifting element is a liquid crystal film.

The expression "surface relief" is used to refer to a non-planar part of the outwardly facing surface of the first outer layer. The surface relief typically has a plurality of facets angled with respect to the surface of the first outer layer so as to define a plurality of elevations and depressions. Light from the colour shifting element is refracted at the interface between the angled facets of the surface relief and the air in a different manner to how it would be refracted at the interface between a planar surface of the first outer layer and the air, and in this way the surface relief interacts with light from the colour shifting element and modifies the first optical effect. The surface relief is provided in the outwardly facing surface of the first outer layer, and is therefore formed in an outwardly facing surface of the polymer substrate for the security sheet. The surface relief typically has a pitch (e.g. the distance between adjacent elevations) in the range of 1-100 μm, more preferably 5-70 μm, and structure depth (e.g. the height of an elevation) in the range of 1-100 μm, more preferably 5-40 μm.

The first outer layer and each of any internal layer positioned between the colour shifting element and the first outer layer comprises at least a region substantially transparent to visible light such that the colour shifting element is visible through the surface relief. This ensures that the second optical effect due to the interaction of light from the colour shifting element with the surface relief is exhibited to (i.e. can be seen by) a viewer. The surface relief is typically provided so as to substantially completely cover the colour shifting element. However, in some examples the surface relief may be provided over a part of the colour shifting element such that different optical effects are provided to the viewer, typically exhibited as regions of different colour. For example, the part of the transparent region that is planar (i.e. where no surface relief was formed) will exhibit the first optical effect (typically a red to green colour shift), and the surface relief will exhibit the second optical effect (typically a red to green to blue colour shift).

Here the expression "overlapping" includes partially overlapping and fully overlapping. Typically the polymer layers have substantially the same cross sectional area and are provided in a fully overlapping manner such that they are aligned with each other in a direction normal to the polymer layers. The term "self-supporting" means that each layer may be provided individually and maintain its structure independently of the polymer substrate.

The colour shifting element and the surface relief may form a security device in its own right, such that each polymer substrate comprises the same security device which exhibits a memorable effect to a viewer that is easy to authenticate and yet difficult to counterfeit. However, a further benefit of the invention is that the surface relief of the substrate may be selectively modified in order to produce unique, "personalized" finished security sheets as described above in relation to the first aspect of the invention. Therefore, if a plurality of polymer substrates formed by the third aspect of the invention are provided to a security sheet manufacturer, each substrate may be individually modified so as to define indicia unique to that security sheet (for example biometric data relating to a holder to a passport or identity card). This ability to efficiently generate unique personalized security sheets using polymer substrates formed by the present invention is particularly beneficial.

Typically the surface relief is formed in the outwardly facing surface of the first outer layer by an embossing process.

Preferably, at least one of the plurality of polymer layers comprises a plastic material, preferably polycarbonate, polyethylene terephthalate (PET) or polyethylene terephthalate glycol-modified (PETG). The use of a plastic material advantageously provides a rigid or at least semi-rigid substrate for a security sheet, such that the finished security sheet is resistant to damage and wear.

The colour shifting element may be viewed in either reflection or transmission. In the case where it is to be viewed in reflection, it is preferable that at least one internal layer comprises an absorbing element, the absorbing element being positioned on a distal side of the colour shifting element with respect to the surface relief and being adapted to at least partially absorb light. This is particularly advantageous when the colour shifting element is partially transparent (such as a liquid crystal). Such a colour shifting element only reflects certain wavelengths of light dependent upon its structure, with the remainder of the light incident upon the colour shifting element being transmitted through the colour shifting element and impinging upon the absorbing element. The absorbing element is sufficiently opaque to absorb the wavelengths of light that are not reflected by the colour shifting element such that the light reflected from the colour shifting element dominates the optical effect exhibited to the viewer.

Preferably, the absorbing element has black or dark areas. However, this is not essential so long as the absorbing element at least partially absorbs light transmitted through the colour shifting element such that the light reflected off the colour shifting element dominates the optical effect exhibited to a viewer. The absorbing element may typically comprise a substantially opaque polymer or a substantially opaque ink.

The absorbing element is positioned on a distal side of the colour shifting element with respect to the surface relief, and there are a number of ways in which this can be arranged. For example, the colour shifting element and the absorbing element may be positioned on the same internal layer. In such a case, they may be positioned on the same surface of the internal layer, or on (preferably in contact with) opposing surfaces of the internal layer. In the case where the colour shifting element and the absorbing element are positioned on the same surface of the internal layer, the colour shifting element is positioned on top of the absorbing element such that it is positioned between the absorbing element and the surface relief. However, both the colour shifting element and the absorbing element are supported by the same internal layer.

As another example, the colour shifting element and the absorbing element may be positioned on (preferably in contact with) separate internal layers.

The colour shifting element and the absorbing element may be provided in register. The term "in register" is used to mean that the colour shifting element and the absorbing element are substantially aligned with each other in a direction normal to the polymer layers (i.e. overlapping) and are in the same relative positions on a plurality of substrates for security sheets.

Advantageously, the absorbing element may define indicia. As described above, the absorbing element absorbs wavelengths of light that are transmitted through the colour shifting element such that the light reflected off the colour shifting element dominates. Therefore, where the absorbing element defines indicia, only part of the colour shifting element will be positioned between an absorbing element and the surface relief, with that part of the colour shifting element corresponding to the indicia of the absorbing element. Therefore, when viewed in reflection, the part of the colour shifting element corresponding to the indicia will be most readily observable, providing a memorable effect to the viewer. Where a substantially opaque colour shifting element is used (such as an optically variable pigment), the colour shifting element itself may define indicia.

The plurality of overlapping polymer layers may comprise a substantially opaque internal layer positioned between the colour shifting element and the first outer layer, the substantially opaque internal layer comprising a window region substantially transparent to visible light through which the colour shifting element is viewable. The window region and the colour shifting element are typically in register. The term "in register" has the same meaning as above, in that the colour shifting element and the window region are substantially aligned with each other in a direction normal to the polymer layers and are in the same relative positions on a plurality of substrates for security sheets. The window region may define a shape, such that the colour shifting element is viewed as a shape defined by the window region. Such a shaped window advantageously improves security of the substrate.

The surface relief may take a number of different forms that may each provide a different optical effect to a viewer. For example, the surface relief may comprise a microprismatic structure, wherein the microprismatic structure comprises a plurality of microprisms. Such a microprismatic structure may comprise an array of linear microprisms, wherein typically the long axes of the microprisms within an array are parallel to each other. Such a microprismatic structure typically has a pitch (e.g. the width of an individual microprism) in the range of 1-100 μm, more preferably 5-70 μm, and structure depth (e.g. the height of an individual microprism) in the range of 1-100 μm, more preferably 5-40 μm.

Such a microprismatic structure may comprise two or more arrays of linear microprisms, wherein the long axes of one array are angularly offset from the axes of the other array. The second optical effect provided by the interaction of the array of microprisms with light from the colour shifting element is most readily observed when the microprisms are viewed in a direction perpendicular to the long axes of the microprisms. Therefore, a microprismatic structure comprising two or more arrays of microprisms offset from each other allows for a second optical effect that is readily observed when the substrate is rotated within its plane (i.e. viewed at different azimuthal angles).

The microprisms of a microprismatic structure may have a symmetrical or asymmetrical structure. The microprisms of a microprismatic structure may have a repeating faceted structure.

Such a microprismatic structure may be a one-dimensional microprismatic structure, meaning that it is comprised of a plurality of one-dimensional microprisms. The term "one-dimensional" is used here to mean that the second optical effect produced by an individual microprism within the structure is significantly stronger (i.e. more noticeable to a user) in one direction of viewing (i.e. in a direction perpendicular to a long axis of the microprism).

The surface relief may alternatively or additionally comprise a microprismatic array comprising a two-dimensional microprismatic structure, meaning that it is comprised of a plurality of two-dimensional microprisms. Here there term "two-dimensional" is used to mean that the second optical effect produced by an individual microprism is readily noticeable to a viewer in more than one direction of viewing. Such a two-dimensional microprismatic structure may comprise a pyramidal or corner cube structure for example.

Alternatively or in addition to a microprismatic structure, the surface relief may comprise a lenticular array having a curved surface structure.

In some examples, the second outer layer and each of any internal layer positioned between the colour shifting element and the second outer layer comprise at least a region substantially transparent to visible light such that the colour shifting element is visible through a second surface relief provided in the outwardly facing surface of the second outer layer, the second surface relief being adapted to interact with light from the colour shifting element in order to modify the first optical effect. The provision of such a second surface relief is particularly beneficial when the colour shifting element is substantially opaque to visible light (for example an optically variable pigment). In such a scenario, the viewer will see optical effects from both sides of the polymer substrate due to the modification of light reflected from the colour shifting element by the surface relief in the first outwardly facing surface, and the second surface relief. Such a polymer substrate comprising two surface reliefs in opposing outwardly facing surfaces advantageously provides a memorable effect to a user, and enhanced security of the finished security sheet.

The polymer substrate may further comprise a second colour shifting element positioned on a distal side of the first colour shifting element with respect to the first polymer layer, and wherein the second outer layer and each of any internal layer positioned between the second colour shifting element and the second outer layer comprise at least a region substantially transparent to visible light such that the second colour shifting element is visible through a second surface relief provided in the outwardly facing surface of the second outer layer, the second surface relief being adapted to interact with light from the second colour shifting element in order to modify the optical effect provided by the second colour shifting element. This is particularly advantageous in the case where the colour shifting elements are partially transparent (i.e. transmit at least a proportion of visible light incident upon it), as the effect of light transmitted through the colour shifting elements on the optical effects exhibited to a viewer through the first and second surface reliefs is reduced.

It is further preferable to provide an absorbing element between the first and second colour shifting elements in order to substantially absorb light transmitted through the colour shifting elements. Such an absorbing element may beneficially define indicia.

The surface reliefs formed in the first and second outer layers may overlap each other, typically in a fully overlapping manner. In other words, when the surface reliefs fully overlap they are aligned in a direction normal to the first and second polymer layers. Alternatively, the surface reliefs may be offset from each other (i.e. there is no overlap between the surface reliefs).

The second surface relief is preferably formed by an embossing process, and may take a number of different forms that may each provide a different optical effect to a viewer, as described above in relation to the surface relief formed in the outwardly facing surface of the first polymer layer. For example, the second surface relief may comprise a microprismatic structure, typically a plurality of microprisms. The microprismatic structure may comprise an array of linear microprisms. The microprismatic structure may comprise two or more arrays of linear microprisms, wherein the long axes of one array are angularly offset from the axes of the other array. The microprisms may have an asymmetrical and/or repeating faceted structure. The microprismatic structure may be a one-dimensional microprismatic structure or a two-dimensional microprismatic structure such as a pyramidal structure. The second surface relief may comprise a lenticular array having a curved surface structure. The second surface relief typically has a pitch (e.g. the distance between adjacent elevations) in the range of 1-100 μm, more preferably 5-70 μm, and structure depth (e.g. the height of an elevation) in the range of 1-100 μm, more preferably 5-40 μm.

The second outer layer may comprise a viewing region substantially transparent to visible light. Such a viewing region may be translucent. Typically, such a viewing region has a planar form such that it does not interact with light from the colour shifting element of the polymer substrate (either when one, or more than one, colour shifting element is provided). Such a viewing region advantageously provides a different optical effect to a viewer when they view the second outwardly facing surface of the polymer substrate as opposed to the first outwardly facing surface. The surface relief formed in the outwardly facing surface of the first polymer layer and the viewing region may overlap each other, or they may be offset from each other as in the case where two surface reliefs are provided.

In accordance with a fourth aspect of the present invention there is provided a security sheet formed from the polymer substrate of the third aspect of the invention. The security sheet may advantageously comprise indicia unique to the security sheet, beneficially enhancing the security of such a security sheet. For example, the security sheet may be a security sheet for a passport, and the indicia comprises biometric data (such as a portrait) relating to the passport holder. The indicia may be provided in the original surface relief(s) of the polymer substrate, or may be provided by selective modification of the surface relief(s), as outlined above. Such selective modification is particularly advantageous as it enables efficient personalization of security sheets.

Typically, the security sheet is a security sheet for a passport, a driving license, an identification card, a security label or other document of value.

According to a fifth aspect of the present invention there is provided a document of value comprising a security sheet of the fourth aspect of the invention. The document of value may be a passport, a driving license, an identification card, a security label or other document of value.

BRIEF DESCRIPTION OF THE DRAWINGS

The invention will now be described with reference to the attached drawings, in which:

FIGS. 12*a*, 12*b*, 13*a* and 13*b* to 20 illustrate example laminar structures that may be used in the present invention;

DETAILED DESCRIPTION

Figure 1A:
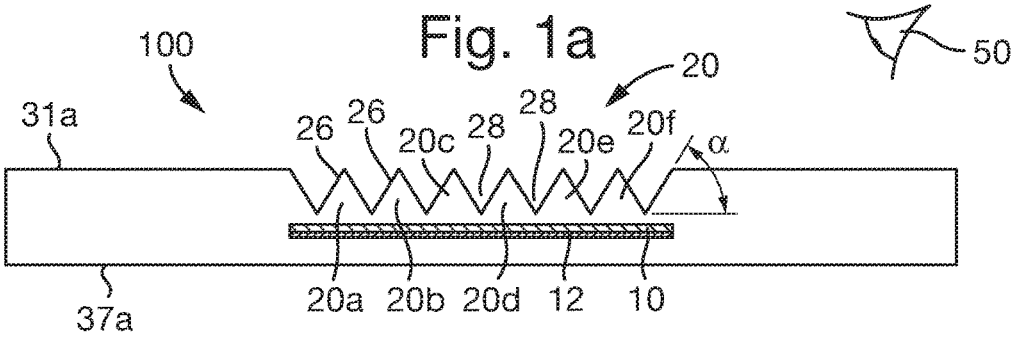
FIGS. 1*a* and 1*b* are schematic cross-sectional diagrams of example substrates for a security sheet according to an example of the invention.

FIG. 1*a* is a schematic cross-sectional diagram of an example substrate 100 for a security sheet according to the present invention. The substrate 100 comprises a plurality of polymer layers that are joined together (see FIGS. 2*a* and 2*b*). The substrate 100 has a first outer surface 31*a* and a second outer surface 37*a*. The thickness of the substrate 100, which is the distance between the first and second outer surfaces 31*a*, 37*a*, is preferably at least approximately 150 μm and more preferably at least approximately 300 μm. In particular, the substrate 100 may be between approximately 300 μm and 1000 μm thick and, for example, may be approximately 800 μm thick. The substrate 100 may be substantially rigid or at least semi-rigid by virtue of its thickness and polymer (typically plastic) composition.

Within the substrate 100 is a colour shifting element 10 that provides an optically variable effect to a viewer 50 as is known in the art. Examples of such a colour shifting element include photonic crystals, liquid crystals, interference pigments, pearlescent pigments, structured interference materials or thin film interference structures including Bragg stacks.

A surface relief 20 is formed in the first outer surface 31*a* of the substrate 100 so that it is positioned above and in register (i.e. aligned with) with the colour shifting element 10, such that light from the colour shifting element passes through the surface relief 20 before reaching the viewer 50. The surface relief 20 of the example substrate 100 comprises an array of parallel linear microprisms 20*a*, 20*b* . . . 20*f* defining a plurality of elevations (shown generally at 26) and depressions (shown generally at 28). The microprisms seen in FIG. 1*a* are symmetrical triangular linear microprisms having equal length facets 22, 24 at an angle α to the first outer surface 31*a* and have long axes that extend into the plane of the page.

Light from the colour shifting element 10 interacts with the surface relief 20 in such a manner that the combination of the colour shifting element 10 and the surface relief 20 provides a different optical effect to the viewer than would be exhibited by the colour shifting element 10 in isolation. More specifically, the angled facets of the surface relief 20 refract light incident to, and reflected from, the colour shifting element 10. This provides an optical effect that is exhibited closer to a normal angle of viewing with respect to the substrate 100, and may provide a larger range of visible colours on tilting of the substrate compared to the colour shifting element 10 in isolation. For example, the combination of the colour shifting element 10 and the surface relief 20 may provide a red to green to blue colour shift on tilting away from a normal angle of viewing, whereas the colour shifting element in isolation would only exhibit a red to green colour shift on tilting.

In this way, the surface relief 20 can be seen to "modify" the light reflected from the colour shifting element 10. The light modification properties of the surface relief are most noticeable when the device is viewed in a direction perpendicular to the long axes of the microprisms of the surface relief.

The substrate 100 can be designed to be viewed either in transmission or reflection, as the colour shifting properties of the colour shifting element 10 are exhibited in either mode of viewing. In the case of viewing in reflection, it is desirable to place a dark absorbing element (shown at 12) beneath the colour shifting element 10 in order to absorb light that is transmitted through the colour shifting element without being reflected. This is particularly beneficial if the colour shifting element 10 is at least partially transparent to visible light. Examples of such partially transparent colour shifting elements include a liquid crystal layer or an all-dielectric multilayer thin film structure. If the colour shifting element 10 is substantially opaque to visible light, then such an absorbing element is typically not required. An example of a substantially opaque colour shifting element is an optically variable pigment.

Figure 1B:
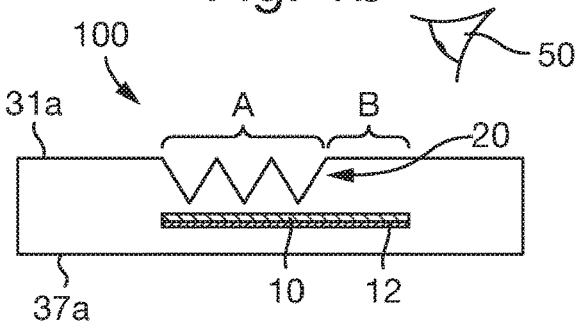

In the example of FIG. 1*a*, the surface relief 20 is formed so as to cover substantially completely the colour shifting element 10. FIG. 1*b* shows an example substrate 100 where the surface relief 20 is formed in the first outer surface 31*a* of the substrate so as to only cover a part of the colour shifting element 10. The substrate 100 will therefore exhibit different regions (shown at A, B) of optical effect to a viewer 50. More specifically, region A may exhibit a red to green to blue colour shift upon tilting of the substrate 100, whereas region B may exhibit a red to green colour shift as the optical effect produced by reflection from the colour shifting element is not substantially modified by the planar part B of the first outer surface where no surface relief is formed. At at least one viewing angle (angle of tilt) of the substrate 100, the substrate will exhibit regions of different colour, for example with region A exhibiting a blue colour and region B a green colour. Different relative dimensions (between 0% and 100% inclusive) of the regions A and B are envisaged, for example the surface relief may cover 25%, 50% or 75% of the colour shifting element 10.

Figure 2A:
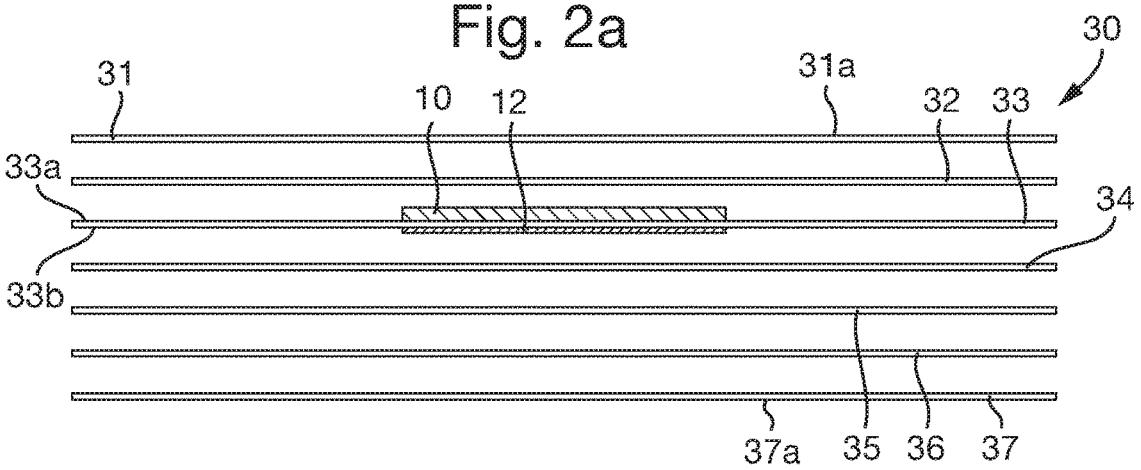
FIGS. 2*a* and 2*b* schematically illustrate the process of forming the substrate 100 according to an example of the invention.
Figure 2B:
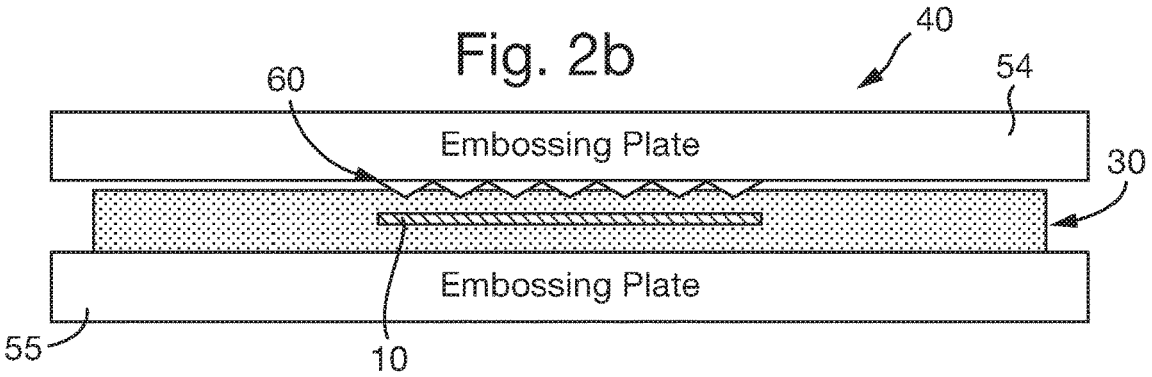

FIGS. 2*a* and 2*b* schematically illustrate the process of forming the substrate 100 according to an example of the invention. As illustrated in FIG. 2*a*, a plurality of typically planar polymer layers 31, 32, 33, 34, 35, 36 and 37 are provided in a fully overlapping manner. Layers 31 and 37 are first and second outer layers respectively, and the outer surface 31*a* of the first outer layer defines the first outer surface 31*a* of the substrate 100, and similarly the outer surface 37*a* of second outer surface 37*a* defines the second outer surface of the substrate 100. The first and second outer layers are typically substantially transparent.

As can be seen in FIG. 2*a*, a plurality of internal layers 32, 33, 34, 35 and 36 are provided positioned between the first and second outer layers 31, 37. For the purposes of this description, moving in a direction from the first ("top") outer layer 31 to the second ("bottom") outer layer 37, layer 32 is the first internal layer, layer 33 is the second internal layer, layer 34 is the third internal layer, layer 35 is the fourth internal layer and layer 36 is the fifth internal layer.

A colour shifting element 10 is provided on and in contact with a first surface 33*a* of the second internal layer 33. Here the first surface is the uppermost surface of second internal layer 33 and is the surface of second internal layer proximal the first outer layer 31. The colour shifting element may be provided on the second internal layer 33 by a variety of methods, such as lamination, printing or sputtering via vacuum deposition which would typically be the case for the different layers of a thin film multilayer interference structure (in the case of optically variable pigments for example).

Optically variable pigments having a colour shift between two distinct colours, with the colour shift being dependent on the viewing angle, are well known. The production of these pigments, their use and their characteristic features are described in, inter-alia, U.S. Pat. Nos. 4,434,010, 5,059,245, 5,084,351, 5,135,812, 5,171,363, 5,571,624, EP-A-0341002, EP-A-0736073, EP-A-668329, EP-A-0741170 and EP-A-1114102. Optically variable pigments having a viewing angle-dependent shift of colour are based on a stack of superposed thin-film layers with different optical characteristics. The hue, the amount of colour-shifting and the chromaticity of such thin-film structures depend inter alia on the material constituting the layers, the sequence and the number of layers, the layer thickness, as well as on the production process. Generally, optically variable pigments comprise an opaque totally reflecting layer, a dielectric layer of a low refractive index material (i.e. with an index of refraction of 1.65 or less) deposited on top of the opaque layer and a semi-transparent partially reflecting layer applied on the dielectric layer.

For the case where the colour shifting element is at least partially transparent, an absorbing element 12 is provided on and in contact with the second surface 33*b* of the second internal layer 33. Here the second surface is the bottommost surface of the second internal layer 33 and is the surface of second internal layer distal the first outer layer 31. As discussed above, such an absorbing element 12 is not essential, but is preferable when the colour shifting element 10 is to be viewed in reflection. The absorbing element 12 has substantially the same cross-sectional area as the colour shifting element 10 and is aligned with the colour shifting element 10 such that the colour shifting element 10 covers substantially the entire absorbing element 12. Other arrangements of the colour shifting element 10 and the absorbing element 12 are envisaged (for example their relative positions), as will be described in the remainder of the description.

The first outer layer 31 and the first internal layer 32 are substantially transparent such that visible light can pass through them. This allows visible light to be incident to and reflected from the colour shifting element 10 such that the colour shifting element 10 is visible through the first outer layer 31 and the first internal layer 32. The second internal layer 33 upon which the colour shifting element 10 is positioned is also substantially transparent. In the case where an absorbing element is not required (for example where the colour shifting element is substantially opaque, such as metal-dielectric multilayer thin films or a printed optically variable pigment), the second internal layer 33 may be transparent or opaque. The third 34, fourth 35 and fifth 36 internal layers are substantially opaque. In general the internal layers positioned between the colour shifting element 10 and the first ("top") outer layer are substantially transparent (or at least have a substantially transparent region) such that the colour shifting element 10 is visible through the top of the finished substrate and the optical variable effects of the colour shifting element are exhibited to a viewer. Typically the internal layers positioned between the colour shifting element 10 and the second ("bottom") outer layer are substantially opaque. Furthermore, the substantially opaque internal layers may comprise marking additives such that they can be laser marked, as is known in the art.

Figure 15:
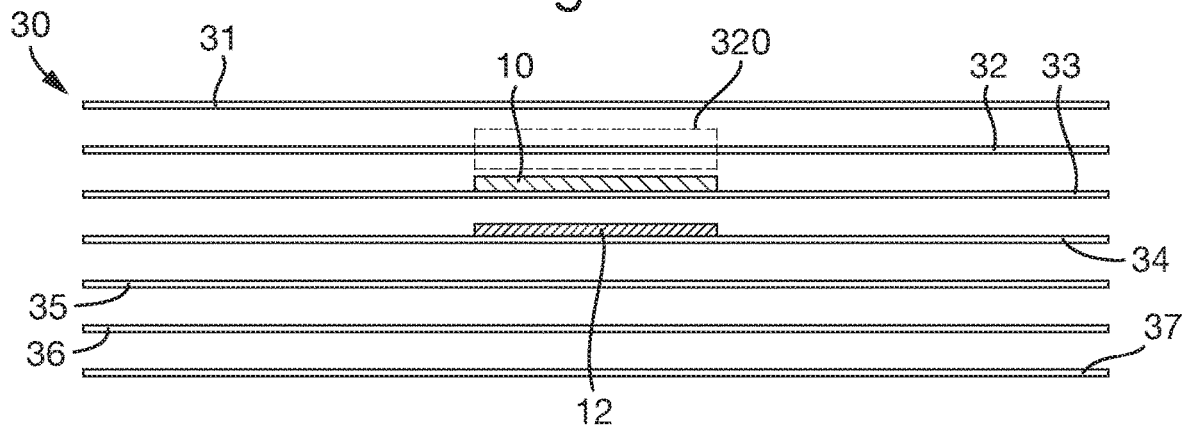

Although in general the internal layers positioned between the colour shifting element 10 and the first ("top") outer layer are substantially transparent, as illustrated in FIG. 15, the colour shifting element 10 may be viewable through a substantially transparent window region in a layer positioned between the colour shifting element 10 and the first outer layer 31. In FIG. 15, the first internal layer 32 is substantially opaque but comprises a window region 320 that is substantially transparent to visible light such that the colour shifting element 10 is viewable through the window region and the first outer layer. The window region may be substantially aligned with and have the same shape as the colour shifting element 10 or may define a different shape such that, when seen by a viewer, the colour shifting element 10 is in the form of a shape defined by the window region 320. The shape may take the form of indicia, such as a crest or logo for example.

The polymer layers are typically formed from a plastic material such as polycarbonate, polyethylene terephthalate (PET) or polyethylene terephthalate glycol-modified (PETG). Polycarbonate is particularly suitable due to its high durability and ease of manufacture. Each of the layers may be between approximately 30 and 200 μm thick.

FIG. 2*b* schematically illustrates a second stage in the process of forming the substrate 100 according to an example of the invention. The plurality of polymer layers are aligned in an overlapping manner (in the view of FIG. 2*b*, fully overlapping such that they are vertically aligned) to form a laminar structure (shown generally at 30) and fed into a laminating apparatus 40 which will be described in more detail with reference to FIG. 3.

As an overview, the laminating apparatus 40 comprises belts 45, 46 with at least one belt comprising an embossing structure corresponding to the desired surface relief 20. The laminar structure 30 is passed through a nip such that the embossing structure on the belt applies pressure to the laminar structure and embosses the surface relief. Heating elements 54, 55 and cooling elements 56, 57 control the temperature of the laminar structure 30 as the surface relief is embossed such that the layers 31, 32, 33, 34, 35, 36, 37 are joined together in a lamination process to form the polymer substrate 100. The lamination and embossing processes occur substantially simultaneously.

A continuous lamination process will now be described in more detail with reference to FIG. 3 (of course a more conventional batch based process could be used where the layers are laminated between a lower and upper heated plate, as schematically illustrated in FIG. 2*b*), which illustrates an example of a lamination apparatus 40 suitable for manufacturing a plurality of security sheet substrates 100. The apparatus comprises a plurality of feeders 41 (here three feeders are shown) for arranging the laminar structure 30 prior to the laminar structure 30 being fed into the laminator 43. The laminator 43 fuses the layers of the laminar structure 30 together by the application of heat and pressure to form a base substrate 101 that is then cut into a plurality of security sheet substrates 100.

The laminator 43 comprises first and second continuous belts 45, 46 which rotate in opposite directions. The first continuous belt 45 comprises a first support surface 47 extending around first inlet and outlet drums 48, 49 and the second continuous belt 46 comprises a second support surface 50 extending around second inlet and outlet drums 51, 52. The first and second support surfaces 47, 50 are substantially adjacent to one another over an elongate laminating region 53 for receiving and pressurizing the laminar structure 30 therebetween.

Opposing heating devices shown generally at 54, 55 are located adjacent to the first and second inlet drums 48, 51 (which define a first nip) within each of the first and second continuous belts 45, 46; and opposing cooling devices shown generally at 56, 57 are located adjacent to the first and second outlet drums 49, 52 (which define a second nip) within each of the first and second continuous belts.

The first support surface 47 of the first belt comprises an embossing structure corresponding to the desired surface relief to be formed in the security sheet substrate. The embossing structure may be in the form of one or more embossing plates (typically steel or nickel) attached to the support surface, or the support surface may be made from a plurality of embossing plates joined together (typically by welding). Each embossing structure is typically a "negative" of the desired surface relief 20—in other words depressions in an embossing structure correspond to elevations in the surface relief 20, and elevations in the embossing structure correspond to depressions in the surface relief 20. In order to form the surface relief 20 depicted in the example security sheet substrate of FIG. 1, the embossing structure comprises an array of parallel microprisms which is a negative form of the array of microprisms of the surface relief 20.

Figure 3:
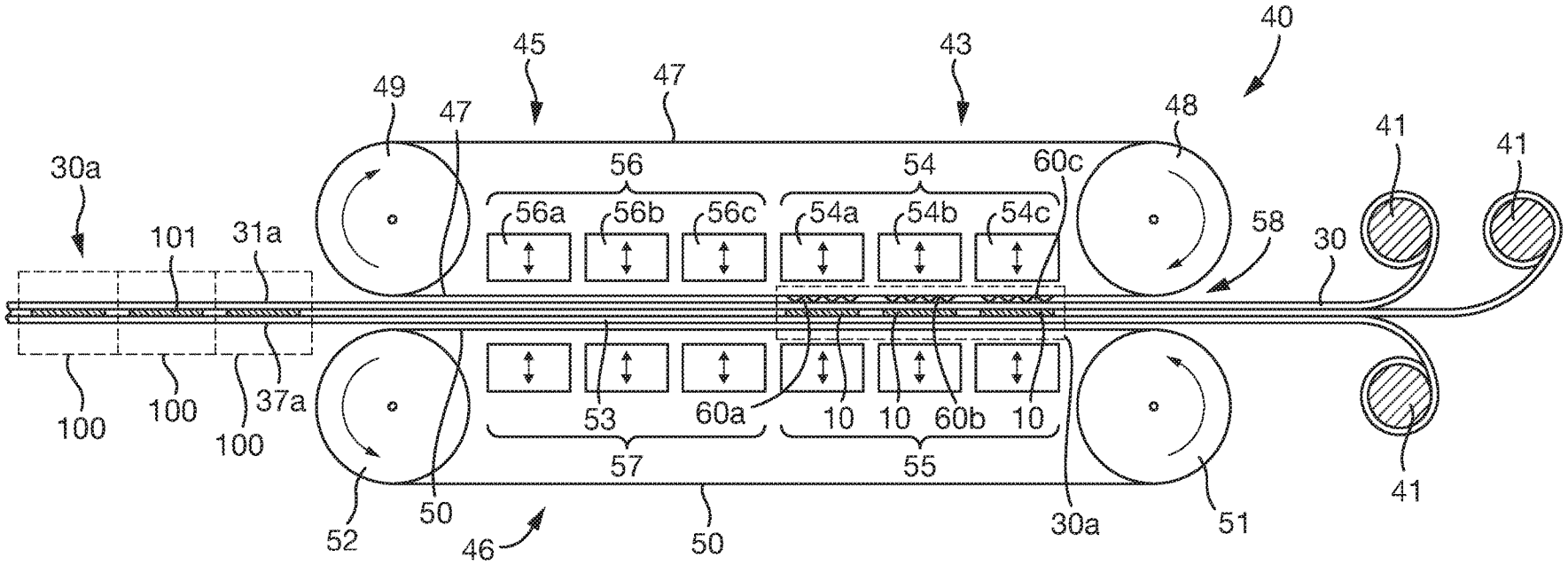
FIG. 3 illustrates an example of a lamination apparatus suitable for manufacturing a plurality of security sheet substrates according to an example of the invention.

For clarity purposes, FIG. 3 shows three embossing plates 60*a*, 60*b*, 60*c* corresponding to the desired surface relief 20 to be formed in the security sheet substrate 100. However, it will be appreciated that the belt 45 may comprise fewer than, or more than, three such plates.

The heating and cooling devices 54, 55, 56, 57 are operable to move towards and away from the first and second support surfaces 47, 50 within laminating region 53 and to apply pressure and temperature control to the laminar structure 30 therebetween. A plurality of alternating heating and cooling devices may be provided along the length of the laminator 43.

In use, at least one of the first and second continuous belts 45, 46 is intermittently driven to draw the laminar structure 30 into the laminator 43 through the first nip. As the laminar structure moves through the nip, the embossing plates on the first support surface 47 apply pressure to the laminar structure so as to form the desired surface relief. As the laminar structure moves between the first and second nips within the laminating region 53, the embossing plates are continuously in contact with, and applying pressure to, the laminar structure 30.

Due to the presence of the embossing plates 60*a*, 60*b*, 60*c* adjacent the first outer layer 31 of the laminar structure, surface reliefs 20 are formed in the outwardly facing surface 31*a* of the first outer layer 31 substantially simultaneously with the formation of the base substrate 101. The laminator 43 is configured such that the surface reliefs 20 are formed aligned with the colour shifting elements 10 and absorbing elements 12 of the laminar structure 30.

As the laminar structure 30 moves through the laminator between the two nips, the heating (54, 55) and cooling (56, 57) devices control the temperature of the embossing plates and laminar structure so as to melt, fuse and set the laminar structure.

The heating devices 54, 55 move towards the first 47 and second 50 support surfaces adjacent the laminar structure 30 to heat the laminar structure to form the base substrate 101. During the heating process each of the polymer layers 31, 32, 33, 34, 35, 36, 37 of the laminar structure 30 become at least softened or semi-molten (i.e. a liquid of relatively high viscosity) so that the polymer flows and mixes together across the interfaces between them. This fuses the layers together so as to form the base substrate 101. The softened or semi-molten state of the layers allows the embossing plates 60*a*, 60*b*, 60*c* to form the surface relief 20 in at least the first outer layer of the laminar structure at substantially the same time as the layers of the laminar structure 30 are fused together.

In the example illustrated in FIGS. 2*a* and 2*b*, the surface relief 20 extends through the first outer layer 31 and the first internal layer 32 of the laminar structure 30. However, the surface relief 20 may be formed in only the first outer layer 31, or may be formed so as to extend through the first outer layer and more than one internal layer. In general, the combined thickness of the layer(s) above the colour shifting element 10 (i.e. the layer(s) positioned between the colour shifting element 10 and the embossing structure) must be greater than the height of the features of the embossing structure such that the colour shifting element is not fouled by the embossing structure during the formation of the base substrate 101.

The heating devices 54, 55 are in contact with first and second support surfaces for a set period of time, typically less than one minute. After the set period of time, the heating devices 54, 55 move away from the first and second support surfaces and the first and/or second continuous belt 45, 46 is driven to move the region 30*a* to between the cooling devices 56, 57. The cooling devices 56, 57 move towards the first and second support surfaces and cool and apply pressure to the region 30*a* in order to maintain its structure. The embossing plates are still in contact with the laminar structure during the cooling.

In order to achieve the fusing of the layers, the heating devices 54, 55 may be suitably controlled to raise the temperature and pressure applied to the laminar structure 30 to reach the softening point of the polymer layers. A temperature at which deformation and therefore fusing and embossing is possible at a certain pressure can be ascertained using the Vicat softening point test of any of the methods of the ASTM D 1525 and ISO 306 standards. The Vicat softening point may be the temperature at which a specimen is penetrated to a depth of 1 mm by a flat-ended needle with a 1 $mm^2$ circular or square cross-section. In a particular example, the Vicat softening point for polycarbonate can be determined by using a heating rate of 50° C./hr and a load rate of 50N. In a further example for polycarbonate, the heating devices 54, 55 may apply a temperature of approximately 180° C. at approximately 8 MPa to the laminar structure and the cooling devices 56, 57 may apply a temperature of approximately 20° C. to 30° C. and a pressure of 10 MPa to the laminar structure 30. In yet a further example for polycarbonate, the heating devices 54, 55 may apply a temperature of approximately 180 C at approximately 1.6 $N/mm^2$ to the laminar structure 30 and the cooling devices may apply a temperature of approximately 20° C. to 30° C. at a pressure of 3.2 $N/mm^2$ to the laminar structure 30.

After the base substrate 101 has exited the laminator 43, it may be subjected to further processing, for example the addition of further security features to the first and/or second outer surfaces 31*a*, 37*a*. The base substrate 101 is then cut into a plurality of security sheet substrates 100. Each security sheet substrate 100 may then be finished as desired in order to form the finished security sheet, examples of which include a passport security page, a driving licence or an identity card.

In the example of FIG. 3, each region 30*a* of the base substrate 101 had three surface reliefs formed it by the illustrated embossing plates, with each surface relief corresponding to a colour shifting element. Typically, each surface relief is identical and the region 30*a* is cut into three substantially identical security sheet substrates 100, with each security sheet substrate 100 comprising the same surface relief 20. This process is schematically illustrated in FIG. 3. However, it is envisaged that each region 30*a* may form a single security sheet substrate 100, and that the surface reliefs formed by the embossing plates on the belt may combine together form a single surface relief 20. In such a case, the embossing plates on the first support surface 47 may be different to each other.

It will be appreciated that the apparatus 40 may comprise more than three or fewer than three heating and cooling elements, and more than three or fewer than three embossing plates.

In some arrangements, the support surface 50 of the second belt 46 may comprise one or more embossing plates in the same manner as described above for the first belt 45. Such an arrangement advantageously allows simultaneous embossing of surface reliefs in opposing sides of the substrate as seen in FIGS. 22 and 23 for example.

Figure 4:
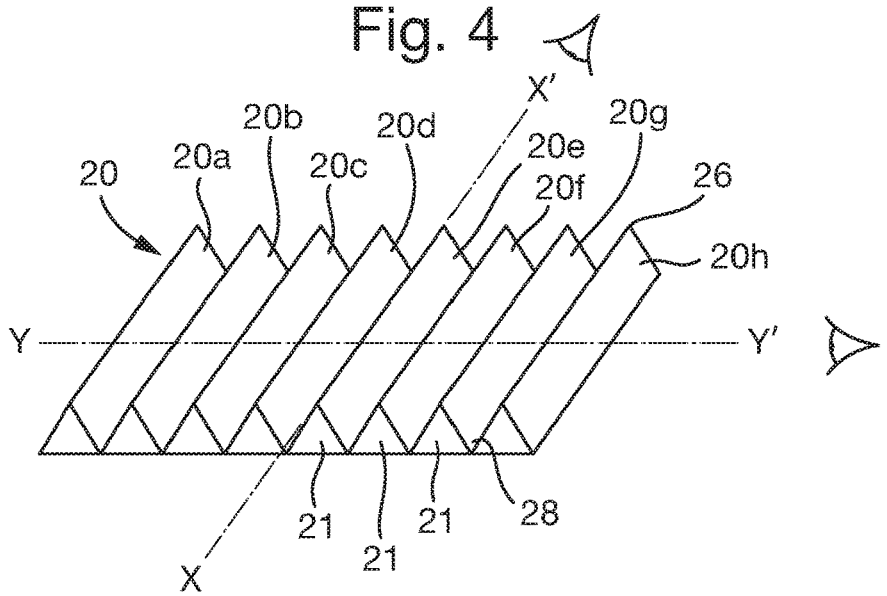
FIG. 4 is an aerial perspective view of a surface relief that may be used according to an example of the present invention.

The above figures have been described with respect to a surface relief comprising a microprismatic structure comprising a plurality of linear microprisms. FIG. 4 is an aerial perspective view of such a surface relief, shown generally at 20. The microprismatic structure comprises an array of linear microprisms 20*a*, 20*b* . . . 20*h* each having a triangular cross section (shown generally at 21). The linear microprisms substantially abut each other along their long axes, and are parallel with each other about their long axes. The array of microprisms defines a series of elevations 26 and depressions 28.

Opposing end faces of an individual microprism are substantially parallel, and such a microprism is known as a "one-dimensional" microprism. The microprismatic structure 20 shown in FIG. 4 is therefore a one-dimensional microstructure as it comprises a plurality of one-dimensional microprisms. The term "one-dimensional" is used because the optical effect produced by the microprism is significantly stronger (i.e. more noticeable to a viewer) in one direction of viewing. In the example of FIG. 4, the effect of the surface relief (e.g. an exhibited red to blue colour shift) is most noticeable if viewed along a direction Y-Y' perpendicular to the long axes of the microprisms.

The optical effect exhibited by the light control structure is therefore anisotropic. If the security sheet substrate comprising the surface relief is rotated within its plane, the exhibited optical effect due to the combination of colour shifting element and surface relief is seen most readily when the substrate is tilted with the viewing direction perpendicular to the long axes of the microprisms (i.e. along Y-Y'). If the substrate is rotated such that the viewing direction is parallel with the long axes of the microprisms (i.e. along X-X'), the effect is seen to a lesser extent.

A variety of different surface reliefs can be provided within the outer surface of a security sheet substrate according to the invention, as will be highlighted with reference to the following FIGS. 5 to 11. In order to generate the different surface reliefs, the embossing structure of the heating element(s) of the lamination apparatus is changed accordingly such that the desired surface relief is formed substantially simultaneously with the lamination process.

Figure 5:
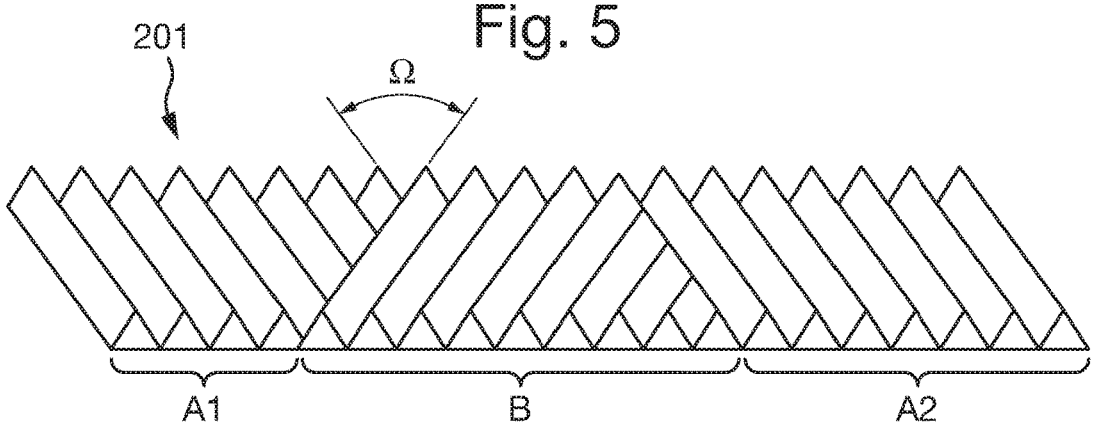
FIG. 5 is an aerial perspective view of an alternative surface relief.

FIG. 5 illustrates an example surface relief 201 that can be formed in the outer surface of a security sheet substrate. The surface relief 201 comprises three regions A1, B and A2, each comprising a plurality of microprisms. The microprisms in each region are parallel with each other, and the microprisms of regions A1 and A2 are parallel. However, the microprisms of region B are offset from those of regions A1 and A2, such that the long axes of the microprisms of regions A1 and A2 define an angle Ω with the long axes of region B. Thus, the surface relief 201 will provide a modifying optical effect when tilted and viewed along a direction perpendicular to the long axes of the microprisms of regions A1 and A2, as well as a readily seen optical effect when the light control structure 201 is rotated and viewed from a direction perpendicular to the long axes of region B. This is in contrast to the surface relief of FIG. 4, where the long axes of the microprisms are aligned in a single direction.

Figure 6:
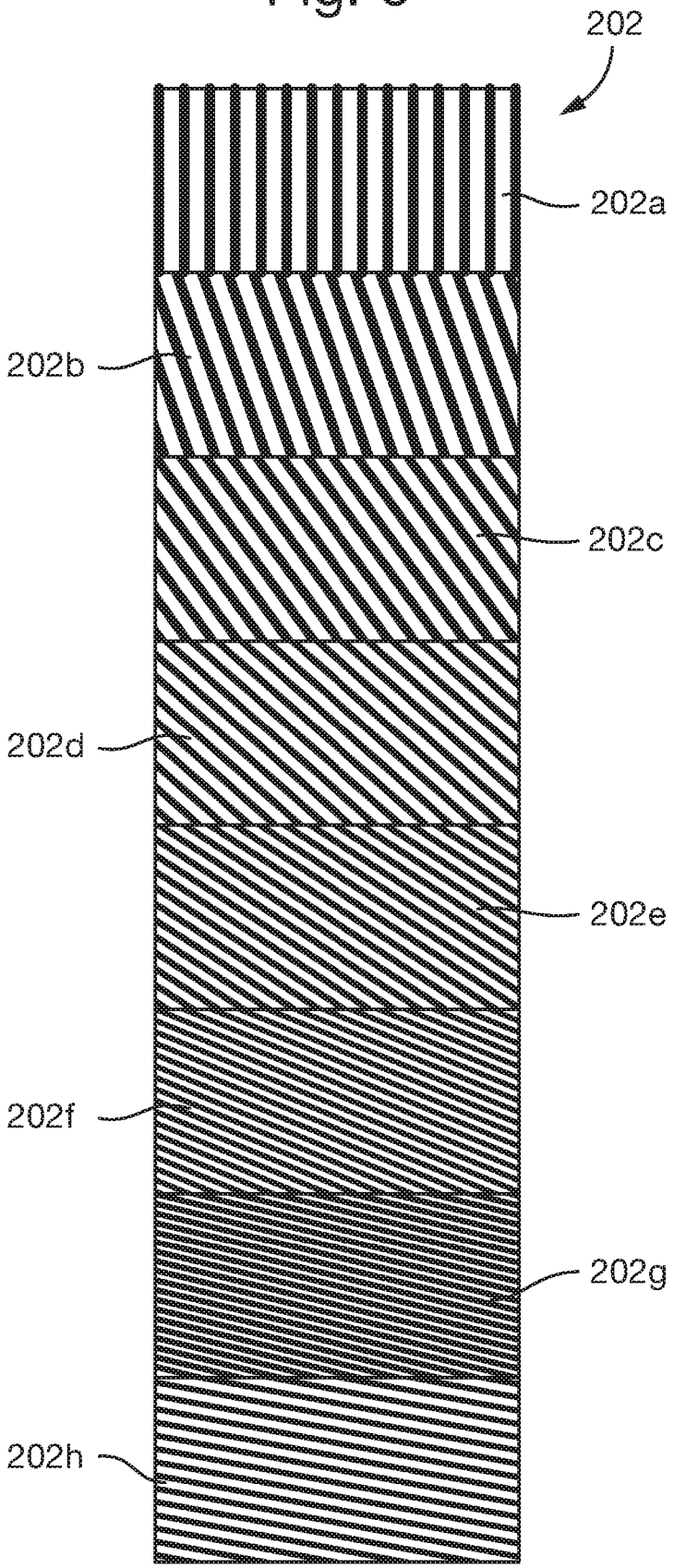
FIG. 6 is a plan view of an alternative surface relief.

It is envisaged that surface reliefs having a plurality of regions offset from each other can be used, as shown in FIG. 6. FIG. 6 schematically illustrates a surface relief 202 comprising a plurality of linear microprisms arranged in a plurality of arrays 202*a*, 202*b* . . . 202*h* rotationally offset to each other.

Figure 7:
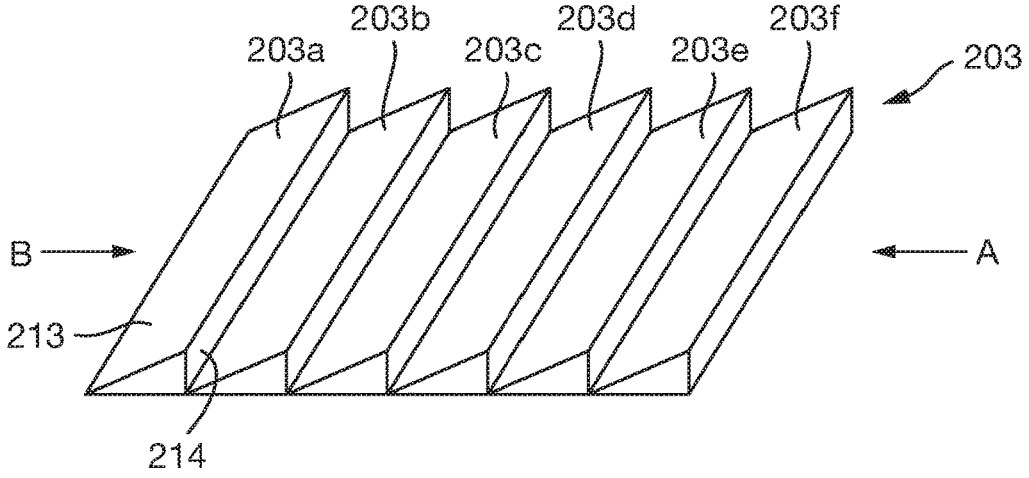
FIGS. 7 to 11 illustrate aerial perspective views of alternative surface reliefs.

FIG. 7 illustrates a surface relief 203 comprising a plurality of microprisms 203*a*, 203*b* . . . 203*f* each having a "saw-tooth" structure, in that one facet (shown here at 213) defines a more acute angle with the outer surface of the security sheet substrate than the other facet of the microprism (shown at 214). Such a saw-tooth structure, when viewed from direction A, will provide a colour shift effect that occurs over a narrow angle of tilt. Conversely, when viewed from direction B, the colour shift occurs over a relatively large angle of tilt.

Figure 8:
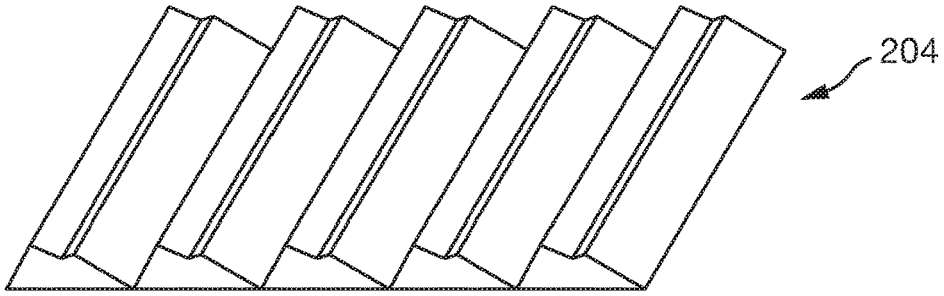
Figure 9:
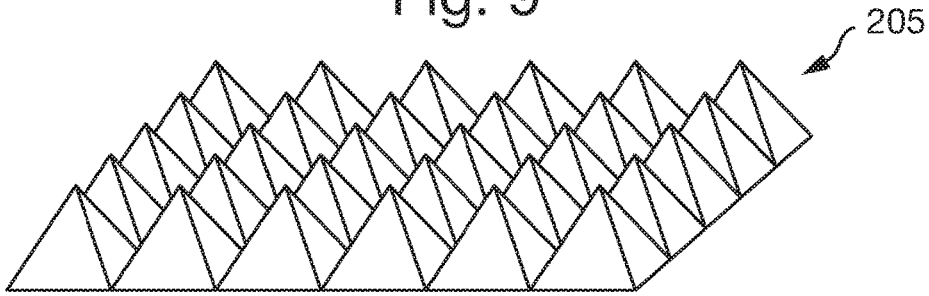
Figure 10:
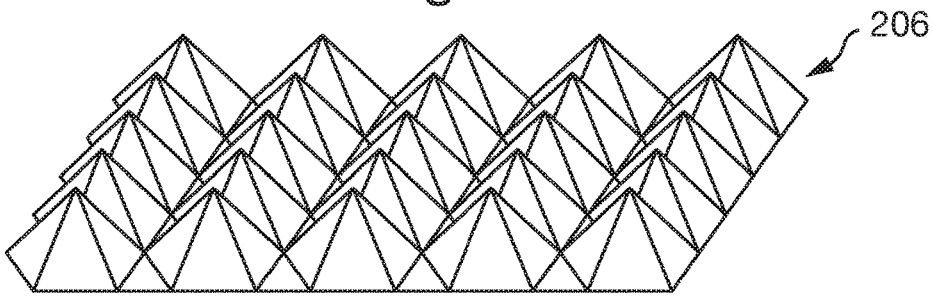

The surface relief may comprise a series of multi-faceted microprisms (i.e. having more than two facets), as shown in the surface relief 204 of FIG. 8.

To obtain more isotropy in the optical properties of the surface relief, a "two-dimensional" microprismatic structure may be used comprising microprisms that are not as rotationally dependent as the linear microprisms of FIG. 4 for example. Such examples include corner cubes, square based pyramid microprisms as depicted in the surface relief 205 of FIG. 9, or more generally polygon-based pyramidal microprisms such as the hexagonal based pyramidal microprisms seen in the surface relief 206 of FIG. 10.

Figure 11:
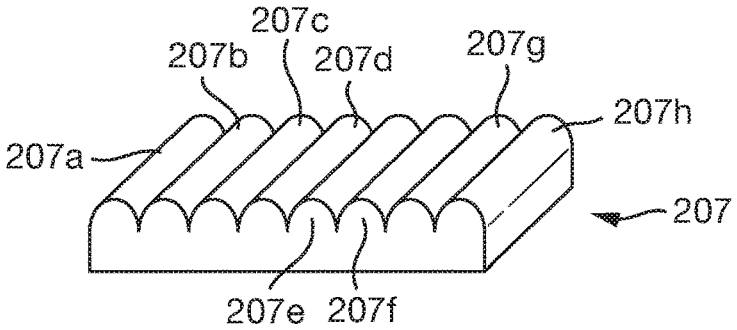

FIG. 11 depicts a surface relief 207 which has a structure similar to a microprismatic structure, but instead of microprisms comprises an array of lecticules 207*a*, 207*b* . . . 207*h* with a domed surface structure.

A security sheet substrate can be provided comprising a colour shifting element and a surface relief as described above in relation to FIGS. 4 to 11 (although other forms of surface relief are envisaged). A particular advantage of the present invention is that the surface relief 20 of the security sheet substrate 100 can be selectively modified in order to form the finished security sheet. A part of the surface relief can be modified through, for example, the addition of resin or selectively removing or deforming a part of the surface relief using a process such as laser ablation. Such modification modifies the optical effect exhibited by the surface relief in the modified part. Therefore, if the modified part of the surface relief defines personalized indicia, the finished security sheet will exhibit a unique optical effect that is memorable to the viewer and difficult to counterfeit. The modification of different surface reliefs (such as those described with reference to FIGS. 4 to 11) can provide a range of memorable optical effects that are difficult to counterfeit.

For example, it is envisaged that a plurality of security sheet substrates 100 formed using the method of the present invention may be provided to a passport provider. Each security sheet substrate comprises the same surface relief. The passport manufacturer can then modify the surface relief of a security sheet substrate in order to define biometric data (such as a portrait) relating to the holder of the finished passport in which the security sheet will be provided. The biometric data will be viewable upon tilting of the security sheet as the modified part of the surface relief will exhibit a different optical effect to the optical effect provided by the original surface relief. This is typically exhibited as a different colour (for example the biometric data appearing green against a blue background upon tilting of the finished security sheet).

In the examples described above, the security sheet substrate comprises a surface relief that covers substantially the entirety of the colour shifting element. However, it is envisaged that a security sheet substrate may be provided where the surface relief covers only a part of the colour shifting element. This may allow for more efficient generation of indicia through modification of the surface relief if, for example, the uncovered part of the colour shifting element defines a large part of a desired indicia that is common to each of the subsequently personalized security sheets.

Another manner in which the security document substrate may be modified is to modify the surface relief on a scale that is not perceptible to the naked human eye. As described above, the optical effect exhibited by the colour shifting element in isolation (e.g. red to green colour shift) differs from the optical effect exhibited by the combination of the colour shifting element and the surface relief (e.g. red to blue colour shift). Therefore, if the surface relief is modified on a scale that is not perceptible to the naked human eye (typically less than 150 μm, preferably less than 70 μm), then the different optical effects provided by the modified and unmodified parts of the surface relief may "mix" together to provide a third optical effect to the viewer. This third optical effect is typically a colour mixing to exhibit a different colour. The surface relief may therefore be modified, for example by adding material or through removing or deforming a part of the relief, in order to provide different colours or hues formed by the combination of optical effects. The exhibited colours may be combined in different ratios dependent on the selective modification of the surface relief.

Figure 12A:
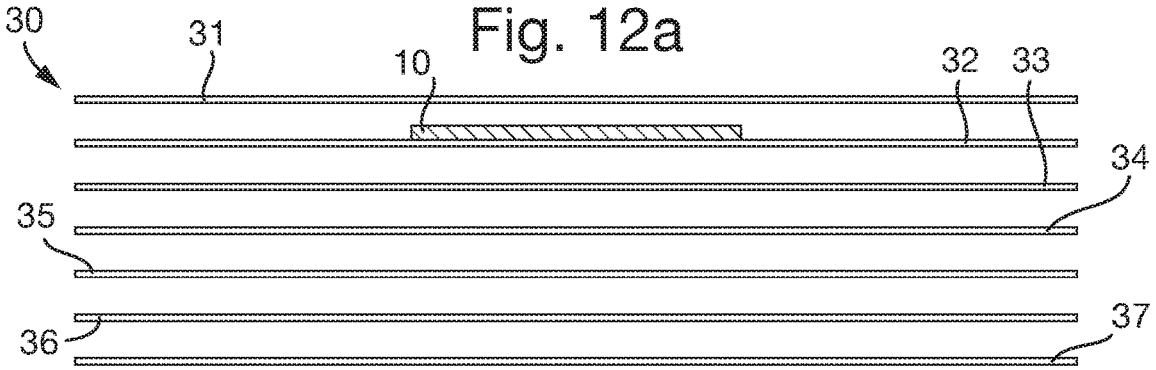

FIG. 2*a* and associated description show the colour shifting element positioned on the second internal layer 33 of the laminar structure 30. However, the colour shifting element may be positioned on any internal layer of the laminar structure 30. For example, FIG. 12*a* shows a laminar structure 30 comprising a colour shifting element 10 positioned on the first internal layer 32. In this case the first 31 and second 37 outer layers and the first internal layer 32 are substantially transparent to visible light and the second 33, third 34, fourth 35 and fifth 36 internal layers are substantially opaque. With the colour shifting element 10 provided on the first internal layer, the light control structure is formed in the first outer layer 31 only. The first outer layer 31 must therefore have a thickness greater than the height of the structures of the embossing structure 60 of the lamination apparatus 40.

Figure 12B:
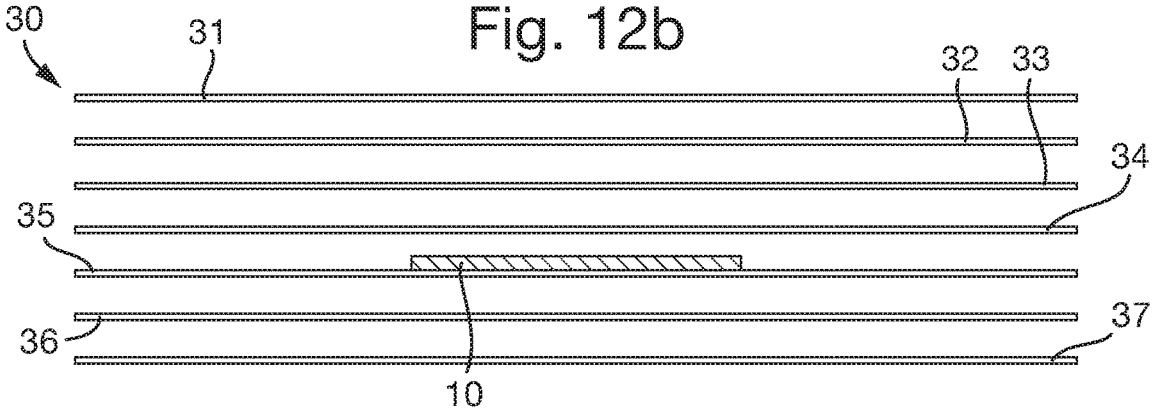

FIG. 12*b* shows a laminar structure 30 comprising a colour shifting element 10 positioned on the fourth internal layer 35. In order that the optical effect of the colour shifting element is visible to a viewer, the first outer layer 31, and first 32, second 33 and third 34 internal layers are substantially transparent to visible light, as well as the second outer layer 37. The fifth internal layer 36 is substantially opaque. In this case, the light control structure 20 may extend through the first outer layer 31, together with the first, second and third internal layer such that the light control structure substantially abuts the colour shifting element. However, the light control structure does not have to extend from the first outer layer to the colour shifting element. For example, the light control structure may only extend through the first outer layer and first internal layer. In such a case, light reflected from the colour shifting element 10 passes through the second and third internal layers without being substantially refracted before being refracted by the surface relief to modify the optical effect provided by the colour shifting element.

As has been discussed, it is not essential for the security sheet substrate 100 to include an absorbing element 12, however it is preferred if the finished security sheet is to be viewed in reflection and is particularly desired if the colour shifting element comprises a liquid crystal. In FIG. 2*a* the colour shifting element 10 and the absorbing element 12 are provided on opposing surfaces 33*a*, 33*b* of the second internal layer 33. However, other arrangements of the colour shifting element 10 and the absorbing element 12 are possible, as described below with reference to FIGS. 13*a* to 17.

Figure 13A:
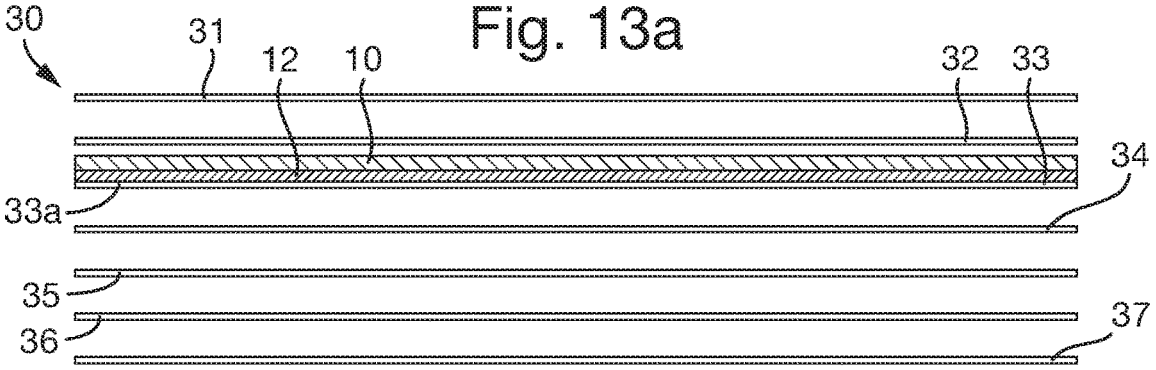
Figure 13B:
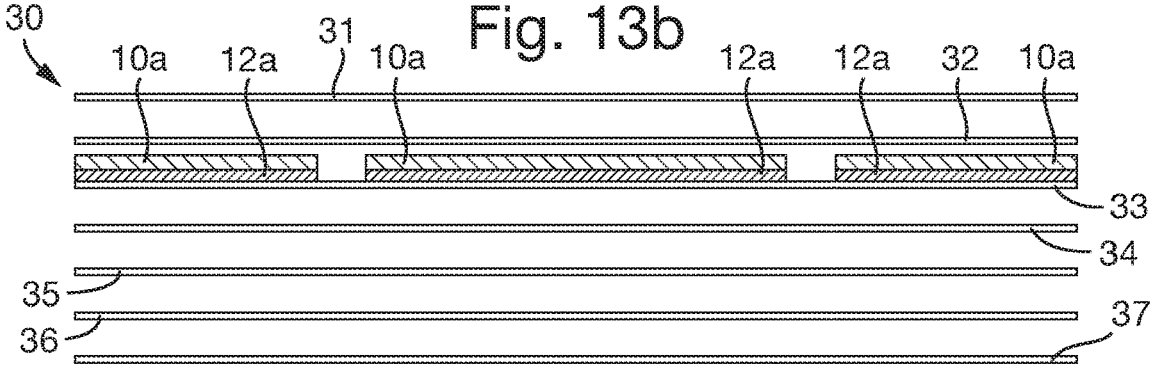

As illustrated in FIG. 13*a*, the colour shifting element 10 and absorbing element 12 may be provided on the same surface of an internal layer. In the example laminar structure 30 of FIG. 13*a*, the colour shifting element 10 and absorbing element 12 are provided on the first (uppermost) surface 33*a* of the second internal layer 33. The colour shifting element 10 is positioned between the absorbing element 12 and the first outer layer 31.

The colour shifting element 10 and the absorbing element 12 may be provided in a patterned fashion on the same surface of an internal layer. In the example laminar structure 30 seen in FIG. 13*b*, the colour shifting element 10 comprises spaced apart regions 10*a*, 10*b*, 10*c* each provided on the first (uppermost) surface 33*a* of the second internal layer. Corresponding regions of absorbing element 12*a*, 12*b*, 12*c* in register with the regions 10*a*, 10*b*, 10*c* of colour shifting element are provided on the same surface 33*a* of the second internal layer. Such patterning of the colour shifting and absorbing elements may be used to define indicia. Examples of such indicia include a portrait of the holder of a passport, driving licence or identity card, or a serial number of a security label.

Figure 14:
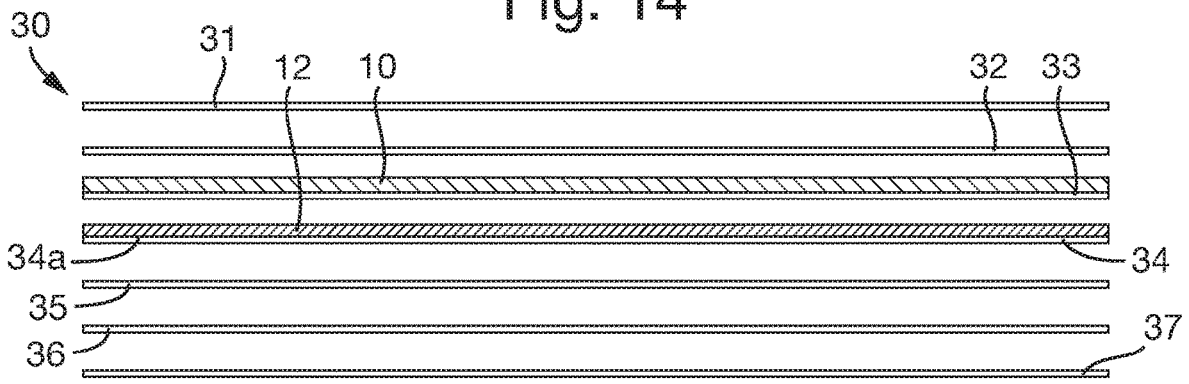

As illustrated in FIG. 14, the colour shifting element 10 and absorbing element 12 may be provided on separate layers. In the example laminar structure 30 of FIG. 14, the colour shifting element 10 is provided on the second internal layer 33 and the absorbing element 12 is provided on the uppermost surface 34*a* of third internal layer 34, which is substantially opaque. The absorbing element 12 may be provided on any internal layer positioned between the colour shifting element 10 and the second (bottommost) outer layer 37 such that the colour shifting element 10 is positioned between the absorbing element and the first outer layer 31.

Figure 16:
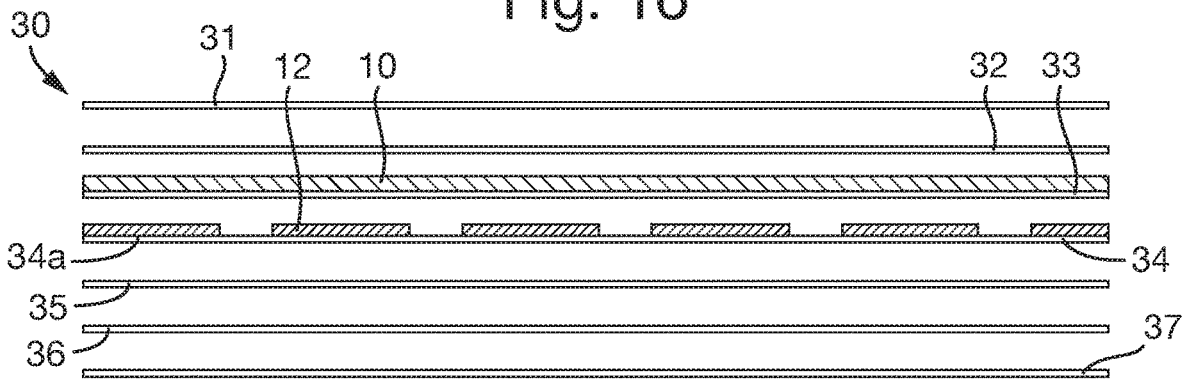

The absorbing element 12 absorbs light that is transmitted through the colour shifting element 10, since the colour shifting element 10 only reflects certain wavelengths of light. This absorption of transmitted light by the absorbing element 12 means that the colour shifting element 10 exhibits a strong optical effect that is readily observed in the areas where the absorbing element 12 is present. This effect can be utilised by providing the absorbing element 12 so as to define indicia, as schematically illustrated in FIG. 16. In such an instance, the areas of the colour shifting element 10 underneath which there is aligned a part of absorbing element 12 will be more readily observed by a viewer. Therefore, if the absorbing element 12 is provided so as to define indicia (for example a logo or a series of characters), the viewer will see an optical effect taking the form provided by the absorbing element. This provides a memorable effect for the viewer that is difficult to counterfeit.

Figure 17:
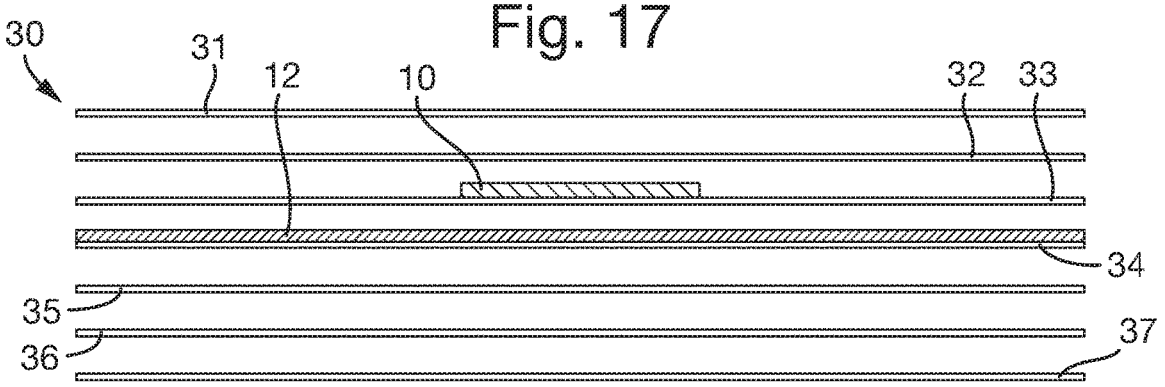

FIG. 17 shows an example laminar structure 30 where the absorbing element 12 is provided over the entirety an internal layer. In this particular example, the colour shifting element 10 is provided on the second internal layer 33 and the absorbing element 12 is provided on the third internal layer 34. However, other spacings of the colour shifting element 10 and the absorbing element 12 are envisaged, as have been discussed above. In this case the absorbing element 12 may be provided by printing substantially opaque ink over the entirety of the third internal layer 34. Alternatively, the absorbing element may be provided by using a black or dark coloured polymer, such as black polycarbonate.

In general, the absorbing element 12 may be provided by printing a black or dark coloured (i.e. substantially opaque) ink onto the desired polymer layer. This is particularly advantageous when the absorbing element 12 is used to define indicia, as the printing allows for accurate spatial application of the ink. Such printing may be carried out using a variety of techniques, such as lithographic, flexographic, screen, gravure or digital printing. Alternatively, the absorbing element may be provided by using a black or dark coloured polymer, such as black polycarbonate.

Figure 18:
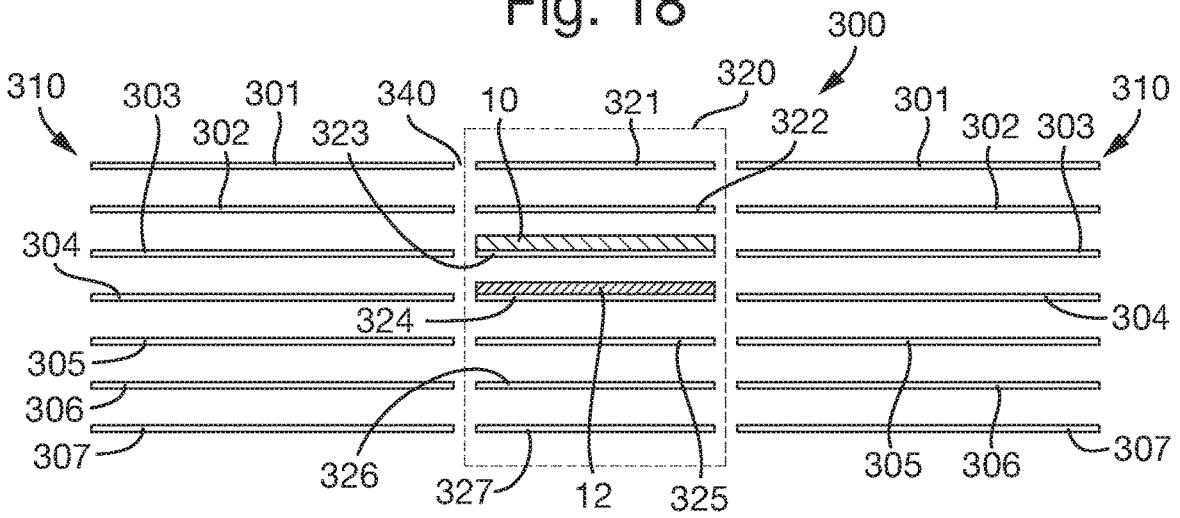

In the examples described so far, the polymer layers 31, 32, 33, 34, 35, 36, 37 that make up the laminar structure 30 are each single unitary layers, and the colour shifting element 10 and absorbing element 12 (where used) are provided at desired locations on their respective layers. For example, in order to form the base substrate 101 as described in relation to FIG. 3, the colour shifting elements 10 are provided at predetermined locations that correspond to the positioning of the embossing structures 60 on the heating devices 54*a*, 54*b*, 54*c* such that in the finished security sheet substrate the colour shifting element and the surface relief are aligned. FIG. 18 schematically illustrates an alternative example laminar structure 300 that can be fed into the laminating apparatus 40.

In the example laminar structure 300 of FIG. 18, the colour shifting element 10 and absorbing element 12 are provided on an insert 320 that is inserted into a plurality of aligned polymer layers in order to form the laminar structure 300 ready for laminating in order to form a security sheet substrate. The laminar structure 300 comprises two identical regions shown at 310 which comprise a plurality of aligned polymer layers 301, 302, 303, 304, 305, 306, 307. In a similar manner to the previously described examples, layers 301 and 307 are first and second outer layers respectively, and layers 302, 303, 304, 305 and 306 are first, second, third, fourth and fifth internal layers respectively.

The insert 320 comprises a plurality of aligned polymer layers, more specifically first and second outer layers 321, 327 and first, second, third, fourth and fifth internal layers 322, 323, 324, 325 and 326. In the present example the colour shifting element 10 is provided on the second internal layer 323 of the insert and the absorbing element 12 is provided on the third internal layer 324 of the insert, although other arrangements are envisaged as described above.

Figure 19:
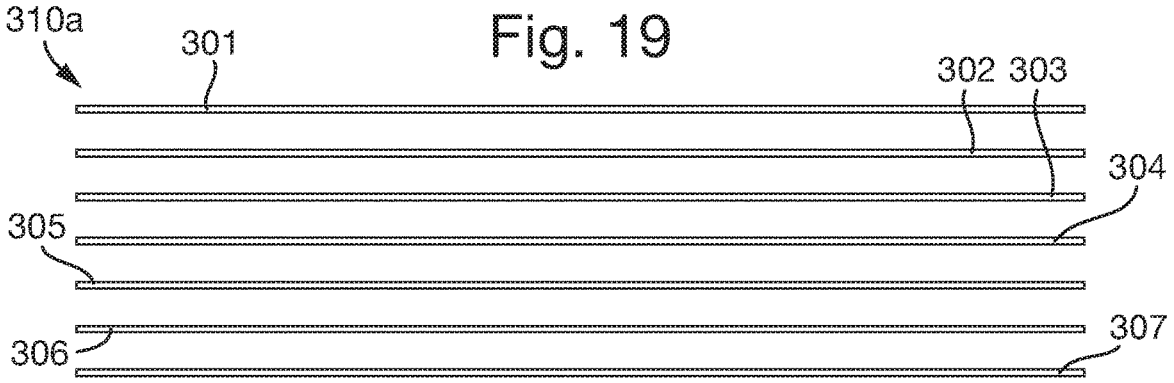

In order to form a laminar structure 300 comprising an insert 320, the plurality of layers forming regions 310 are provided as a blank laminar structure 310*a* that comprises no colour shifting element or absorbing element, as illustrated in FIG. 19. Subsequently, an aperture 340 is formed in the blank laminar structure having an aperture perimeter (e.g. defining a cross sectional area) matching an insert perimeter defined by insert 320. The aperture extends through each of the layers 301, 302, 303, 304, 305, 306 of the blank laminar structure. The insert 320 is then inserted into the aperture 340 such that the layers 321, 322, 323, 324, 325, 326, 327 of the insert 320 align with corresponding layers 301, 302, 303, 304, 305, 306, 307 of the regions 310, so as to form the laminar structure 300.

The insert 320 may be punched from a strip of aligned polymer layers separately to the formation of the aperture in the blank laminar structure 310*a*. However, preferably the aperture and insert are formed and brought together in line, as is disclosed in US2016/0257019. In particular, a single punch component may be operated to form the aperture in the blank laminar structure 310*a*, the layers of which are held together during the punching. The punch component then cuts or punches the insert 320 from the strip and places the insert in the aperture 340. The shape of the aperture 340 matches the shape of the insert perimeter such that their edges are substantially adjacent to and substantially in contact with one another. The insert 320 is preferably friction fitted into the aperture 340, although it may be loosely fitted and held in place by adhesive or other layers of the laminar structure.

It is envisaged that a number of apertures may be formed in the blank laminar structure 310*a* for receiving a plurality of inserts 320. For example, the inserts may be spaced apart by a distance corresponding to the configuration of the laminating apparatus such that, in the finished security sheet substrates, the colour shifting element and the surface relief are substantially aligned and in register.

Figure 20:
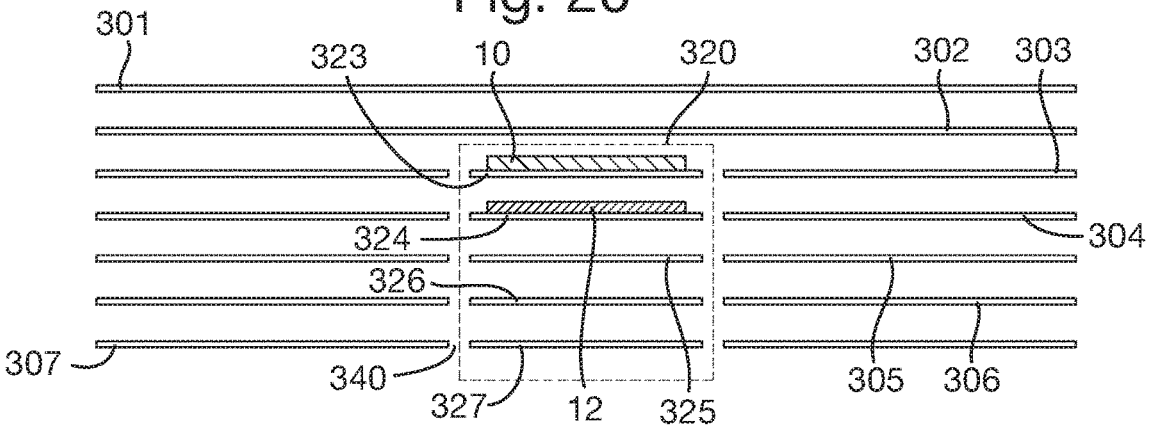

In the above example, the aperture(s) 340 were formed so as to extend through each of the polymer layers 301, 302, 303, 304, 305, 306, 307 of the blank laminar structure 310*a*. However, this is not necessarily the case, and the aperture may only extend through a subset of the layers of the blank laminar structure 310*a*, as illustrated in FIG. 20. Here the aperture 340 extends through the second outer layer 307, fifth internal layer 306, fourth internal layer 305, third internal layer 304 and second internal layer 303. The corresponding insert 320 comprises (using previous notation) second internal layer 323 (upon which the colour shifting element 10 is positioned), third internal layer 324 (upon which the absorbing element 12 is positioned), fourth internal layer 325, fifth internal layer 326 and second outer layer 327.

Once the laminar structure 300 comprising the insert is formed, it may be fed into the laminating apparatus 40 as described in FIG. 3 in order to form one or more security sheet substrates.

Figure 21:
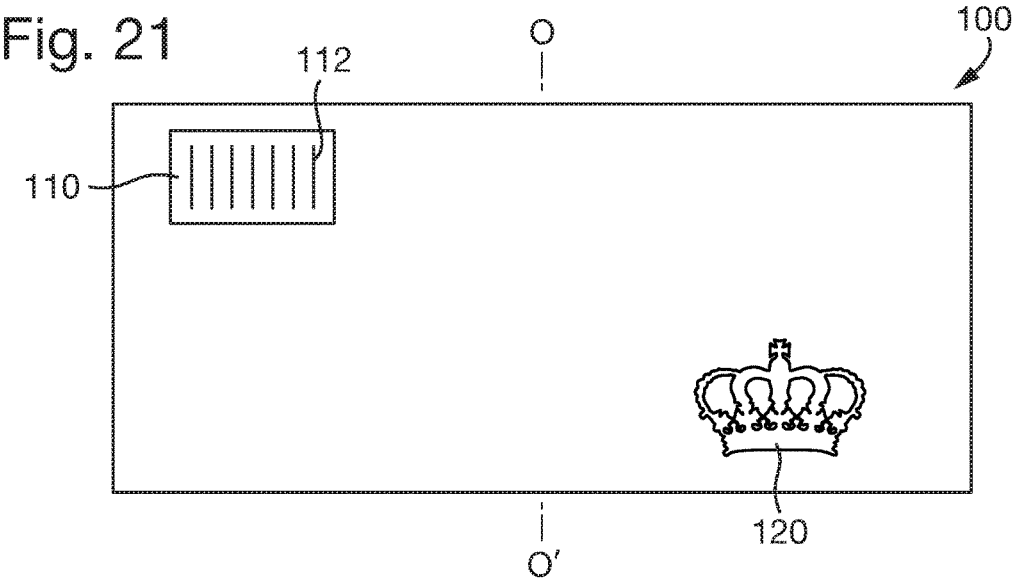
FIG. 21 is a plan view of an example security sheet substrate formed by the present invention.

FIG. 21 is a plan view of an example security sheet substrate 100 formed by the present invention. The security sheet substrate 100 shown in FIG. 21 is substantially rectangular in form and is suitable for applications such as a passport security page, driving license or identity card. However, other geometries and applications of the security sheet substrate are envisaged. The security sheet substrate 100 is typically formed by cutting a base substrate to size, as has been described above in relation to FIG. 3.

The security sheet substrate 100 comprises first 110 and second 120 security features. Each of the security features 110, 120 comprises a colour shifting element and a surface relief formed as described above and is therefore integrated into the security sheet substrate. The first security feature 110 is rectangular in form and comprises a rectangular colour shifting element aligned with a surface relief formed in the top surface of the security sheet substrate. As schematically illustrated in FIG. 21, the surface relief comprises an array of parallel linear microprisms 112 as seen in FIG. 4, although it will be appreciated that other forms of surface relief may be used. The optical effect exhibited by the combination of colour shifting element and surface relief is most readily observed if the security sheet substrate 100 is tilted about an axis parallel with the long axes of the microprisms (for example tilted about the axis O-O'). The first security feature 110 may be used as a security feature in its own right. However, for enhanced security, the surface relief 112 may be selectively modified in order to define indicia through variations in optical effect exhibited to a viewer, as described above. Such a security feature where the surface relief has been modified can provide a unique security feature that is extremely difficult to counterfeit.

As with the first security feature 110, the second security feature 120 comprises a colour shifting element aligned with a surface relief formed in the top surface of the security sheet substrate. The second security feature 120 is in the form of a complex shape, in this case a crown. The shape may be generated either by using an absorbing element beneath the colour shifting element that defines the desired shape, or by using a window region (as described with reference to FIG. 15) having the desired shape, or a combination of both. In the case where a substantially opaque colour shifting element is used, the colour shifting element itself may define the desired shape or indicia. For example, an optically variable pigment may be printed so as to define indicia.

The security sheet substrate 100 can be processed in order to produce a finished security sheet. Finishing processes include selectively modifying the surface structure of a security device as described above, and providing personal data. For example, the uppermost opaque internal layer of the laminar structure 30 that forms the security sheet substrate 100 may be arranged to be laser engraved through the substantially transparent layers. Such an internal layer that is arranged to be laser engraved may comprise a laser markable additive, such as being carbon enriched. A further finishing process may comprise applying at least one further security device to the outer surface(s) of the security sheet substrate.

In the preceding description, security sheet substrates have been described in which a surface relief has been formed in one (typically the uppermost) outer facing surface. However, it is envisaged that a surface relief may be formed in both outer facing surfaces of a security sheet substrate, as will be described below.

Figure 22A:
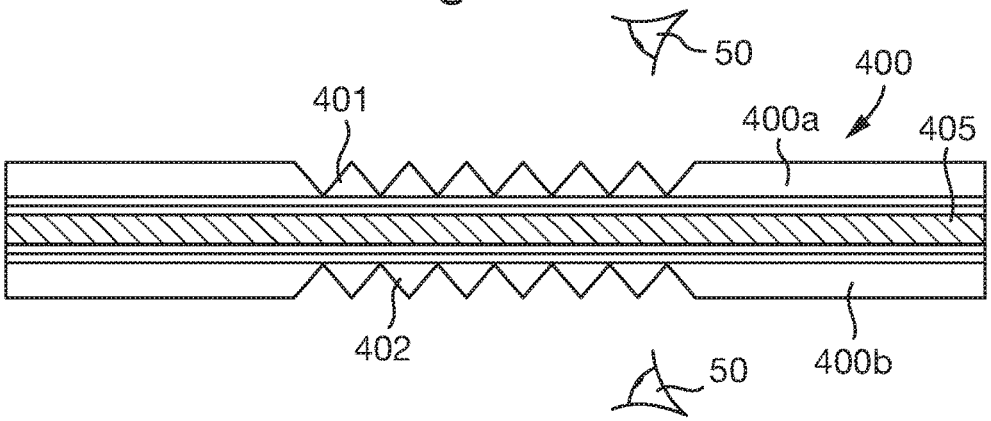
FIGS. 22*a* to 25 schematically illustrate side views of various security sheet substrates.

FIG. 22*a* schematically illustrates a side view of a security sheet substrate 400 formed by substantially simultaneously laminating and embossing a laminar structure as described above. The security sheet substrate comprises first 400*a* and second 400*b* outer layers and a substantially opaque colour shifting element 405 positioned therebetween. The substantially opaque colour shifting element 405 is provided on a substantially transparent internal layer of the laminar structure that is subsequently laminated. In the example security sheet substrate 400 of FIG. 22*a*, the colour shifting element is a printed layer comprising an optically variable pigment. A first surface relief 401 is formed in the first (uppermost) outwardly facing surface 400*a* of the security sheet substrate 400, and a second surface relief 402 is formed in the second (bottommost) outwardly facing surface of the security sheet substrate. The first and second surface reliefs are provided in register with each other (i.e. fully overlapping) and have substantially identical structures such that the security sheet substrate 400 exhibits substantially the same optical effect to a viewer when viewed from either side (i.e. it is symmetrical). In the processing of the security sheet substrate to form the finished security sheet, the first and second surface reliefs may be selectively modified in identical or different ways such that the first and second outwardly facing surfaces of the finished security sheet exhibit substantially identical or differing optical effects. Of course, the surface reliefs 401 and 402 may differ from each other prior to the selective modification.

In order to form a surface relief in the second ("bottom") outwardly facing surface, the apparatus 40 illustrated in FIG. 3 may be adapted such that the second supporting surface 50 comprises embossing structures.

Figure 22B:
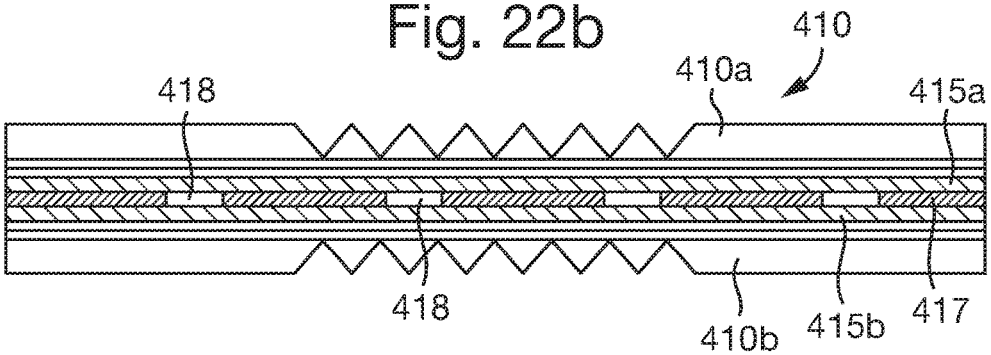

FIG. 22*b* illustrates a further example of a symmetrical security sheet substrate 410 comprising two fully overlapping surface reliefs 411, 412 formed in the first 410*a* and second 410*b* outwardly facing surfaces of the security sheet substrate. Instead of a printed ink comprising an optically variable pigment, the substrate 410 comprises two partially transparent colour shifting elements 415*a*, 415*b* (such as liquid crystal colour shifting elements) and a patterned colour shifting element 417 positioned there between. The presence of the absorbing element 417 ensures that the optical effect exhibited by reflection from the colour shifting element dominates the optical effect exhibited to a viewer 50, and the patterning may be utilised to define indicia. In the case where the absorbing element is patterned (as in FIG. 22*b*), regions of the colour shifting element corresponding to non-absorbing regions of the absorbing element (shown generally at 418) will exhibit a combination of reflective and transmissive colours. Although the absorbing element 417 in security sheet substrate 410 is patterned, typically to define indicia, this is not necessarily the case, and in alternative examples the absorbing element may be uniformly absorbing (un-patterned).

The colour shifting elements 415*a*, 415*b* and the absorbing element 417 may be provided on the same or differing internal layers of the laminar structure prior to lamination to form the security sheet substrate.

Figure 23A:
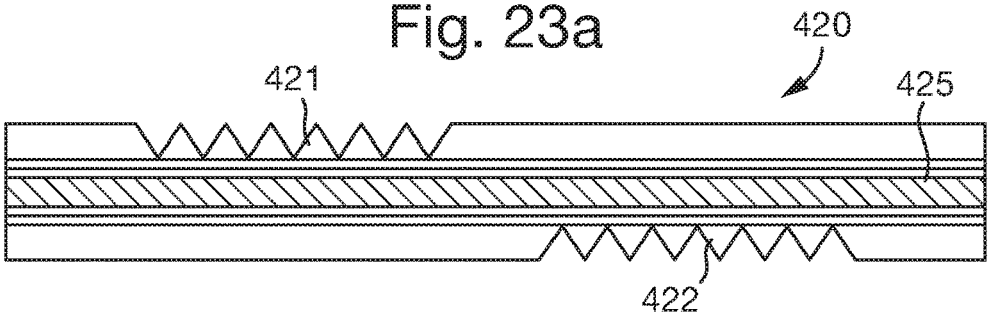

FIG. 23*a* illustrates an example security sheet substrate 420 comprising a first surface relief 421 formed in a first outwardly facing surface 420*a*, and a second surface relief 422 formed on the second outwardly facing surface 420*b*. A substantially opaque colour shifting element (such as a printed ink comprising an optically variable pigment) is provided there between, as in FIG. 22*a*. However, here, the first and second surface reliefs are laterally offset from each other such that they are not substantially overlapping. Other arrangements of the first and second surface reliefs are envisaged, for example partially overlapping.

Figure 23B:
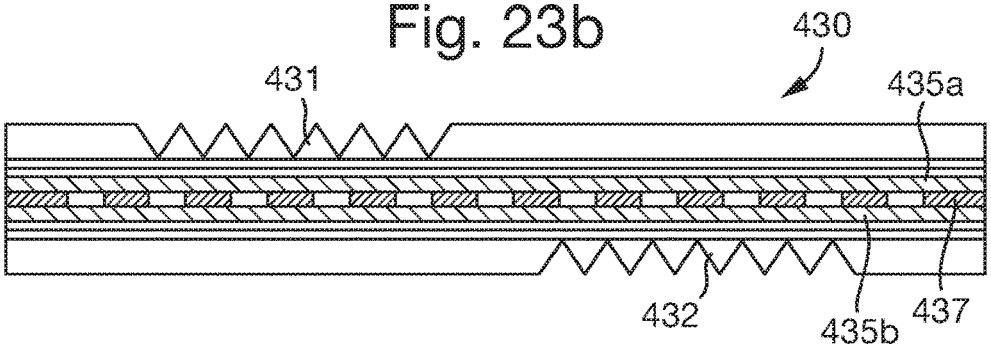

FIG. 23*b* illustrates an example security device 430 similar to that shown in FIG. 22*b*, comprising first and second surface reliefs 431, 432, first and second liquid crystal colour shifting elements 435*a*, 435*b* and a patterned absorbing element 437. However, in contrast to the substrate of FIG. 22*b*, the first and second surface reliefs are provided such that they are not overlapping. Other arrangements of the first and second surface reliefs are envisaged, for example partially overlapping.

Figure 23C:
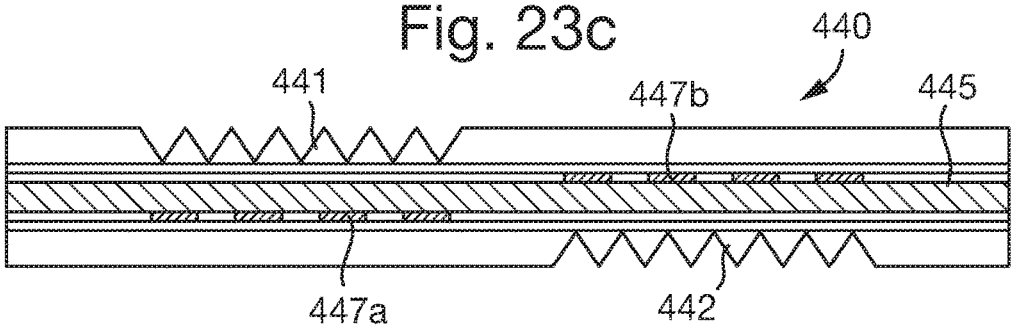

FIG. 23*c* illustrates a further example security sheet substrate 440 comprising first 441 and second 442 surface reliefs formed in respective first 440*a* and second 440*b* outwardly facing surfaces of the substrate 440. The first and second surface reliefs are spaced apart such that they are not overlapping. A partially transparent colour shifting element such as a liquid crystal element 445 is provided between the first and second surface reliefs. First 447*a* and second 447*b* patterned absorbing elements are provided on opposing sides of the colour shifting element 445 and in register with the first surface relief 441 and second surface relief 442, respectively. In other words, the first absorbing element 447*a* is positioned on a distal side of the colour sifting element 445 with respect to the first surface relief 441, and in register with the first surface relief 441 such that light reflected from the colour shifting element is readily viewable by a viewer through the first surface relief 441. Similarly, second absorbing element 447*b* is provided on a distal side of the colour shifting element 445 with respect to the second surface relief 442 such that light reflected from the colour shifting element is readily viewable by a viewer through the second surface relief. Although both absorbing elements 447*a*, 447*b* are illustrated as being patterned (typically so as to define indicia), one or both may be uniformly absorbing (i.e. "un-patterned").

In the view of FIGS. 22*a* to 23*c* above, the second surface relief is illustrated as an array of symmetrical triangular linear microprisms (with their long axes extending into the plane of the page). However, other structures are envisaged, as described above in relation to FIGS. 4 to 11.

Figure 24A:
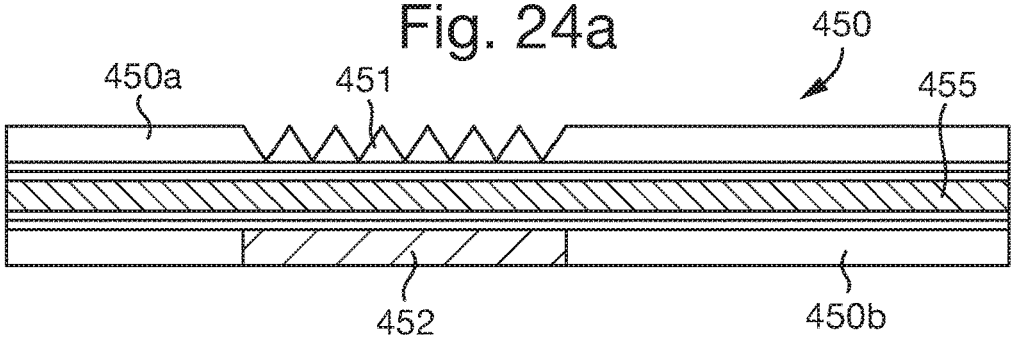

FIG. 24*a* illustrates an example security sheet substrate 450 comprising a substantially opaque colour shifting element 455 (such as a printed ink comprising an optically variable pigment) positioned between opposing first and second outwardly facing surfaces 450*a*, 450*b*. A surface relief 451 is provided in the first outwardly facing surface, and a windowed region 452 is provided in the second outwardly facing surface. The windowed region is substantially transparent to visible light. The security sheet 450 will exhibit, to a viewer looking at the substrate from its uppermost side (i.e. first outer surface), will see an optical effect due to the combination of the colour shifting element 455 and the surface relief 451. A viewer looking at the substrate from its bottommost side will experience an optical effect through the windowed region due to the colour shifting element.

Figure 24B:
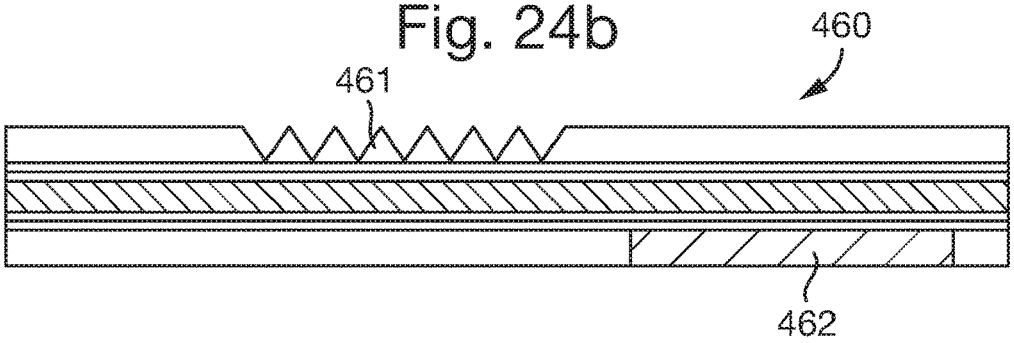

The surface relief 451 and windowed region 452 of the security sheet substrate 450 are provided in alignment such that they substantially fully overlap. However, as seen in the example security sheet substrate 460 of FIG. 24*b*, the surface relief 461 and windowed region 462 may be offset from each other such that they do not overlap. In other examples the surface relief and windowed region may partially overlap.

Figure 25:
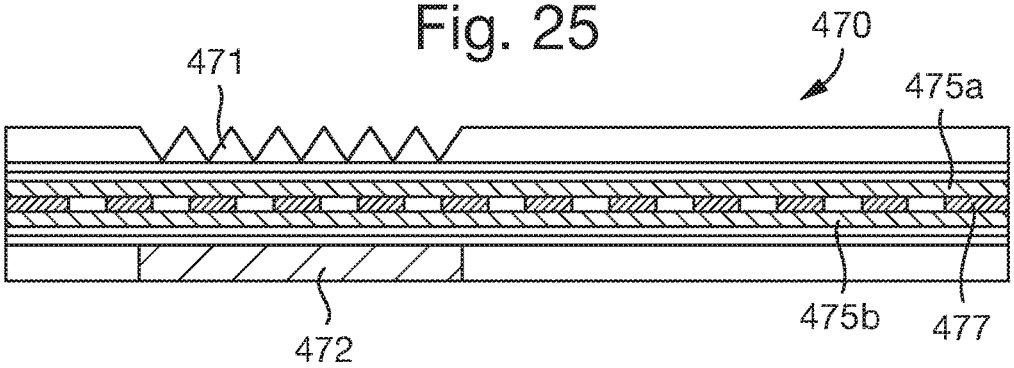

FIG. 25 illustrates an example security sheet substrate 470 having a surface relief 471 and a windowed region 472 in opposing outwardly facing surfaces as explained above with reference to FIG. 24*a*. However, instead of a substantially opaque colour shifting layer, the security sheet substrate 470 comprises first 475*a* and second 475*b* partially transparent colour shifting elements (such as liquid crystal elements) and a patterned absorbing element 477. As in the various examples described hereinabove, the absorbing element may be un-patterned such that it is uniformly absorbing. Furthermore, the surface relief 471 and window region 472 of the security sheet substrate 470 may be offset from each other such that they partially overlap or do not overlap.

Figure 26:
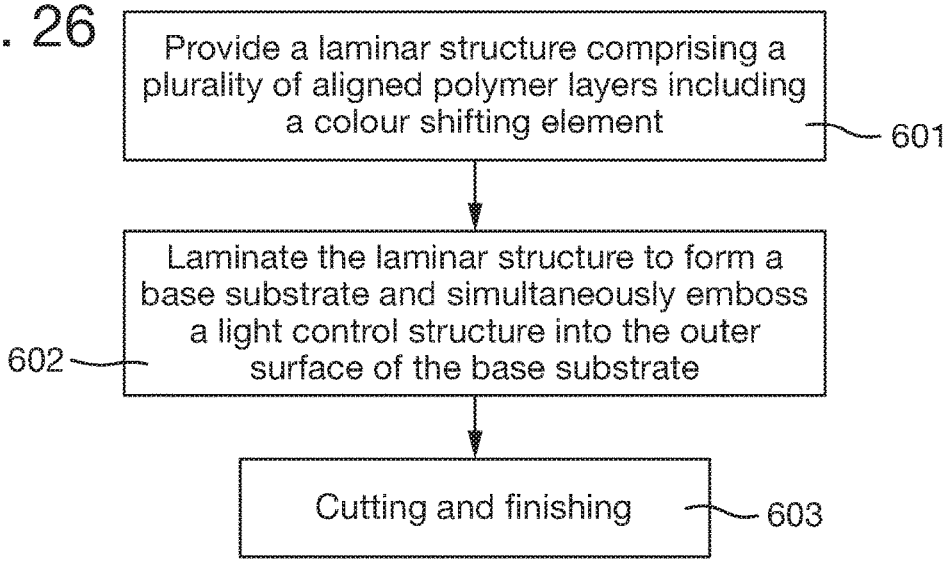
FIG. 26 is a flow diagram outlining the steps of an example method according to the invention.

An example method for forming security sheet substrate is summarized in the flowchart of FIG. 26. At step 601 a laminar structure is provided comprising a plurality of aligned polymer layers. The laminar structure comprises first and second outer layers which are typically transparent to visible light, and at least one internal layer. The at least one internal layer comprises a colour shifting element. The laminar structure may also comprise an absorbing element positioned beneath the colour shifting element operable to absorb light that is transmitted through the colour shifting element without being reflected. The absorbing element is typically used when the colour shifting element is preferred to be viewed in reflection, and is particularly preferred when the colour shifting element is partially transparent, such as a liquid crystal. The colour shifting element and the absorbing element may be arranged relative to one another in a variety of different ways, as has been outlined above.

Next, at step 602, the laminar structure is introduced to a laminating apparatus, such as the apparatus described with reference to FIG. 3. The laminating apparatus comprises at least one heating device and a support surface which comprises an embossing structure. The layers of the laminar structure are fused together in a laminating process due to the application of heat and pressure provided by the heating device via the support surface. Substantially simultaneously, a surface relief is formed in the outer surface of the uppermost outer layer of the laminar structure, the surface relief being substantially aligned with the colour shifting element. In some examples, substantially simultaneously, a second surface relied is formed in the outer surface of the bottommost outer layer of the laminar structure.

Typically the laminar structure that is introduced to the laminating apparatus comprises a plurality of colour shifting elements provided on the same internal layer and spaced apart with a spacing matching that of a plurality of heating devices and embossing structures in the laminating apparatus. The result of the laminating process is therefore a base substrate comprising a plurality of colour shifting elements, each aligned with a surface relief.

Subsequently, at step 603, the base substrate is cut into a plurality of security sheet substrates, with each security sheet substrate comprising at least one integrated security device defined by a colour shifting element and associated surface relief. Typically each security sheet substrate is substantially identical, and a plurality of such security sheet substrates may be provided to a security sheet manufacturer (such as a passport manufacturer) where the security sheet substrate may be processed to form the finished security sheet.

The invention claimed is:

1. A method of forming a polymer substrate for a security sheet, comprising:

providing first and second overlapping polymer layers each providing outwardly facing surfaces, and a colour shifting element positioned between the first and second polymer layers adapted to provide a first optical effect to a viewer, wherein the first polymer layer comprises a region transparent to visible light such that the colour shifting element is viewable through the first polymer layer, and the colour shifting element comprises one of: a photonic crystal structure, a liquid crystal material, an interference pigment, a pearlescent pigment, a structured interference material, or a thin film interference structure; and joining together the first and second polymer layers in order to generate a polymer substrate wherein, during the joining step, a surface relief is formed in the outwardly facing surface of the first layer, the surface relief being adapted to interact with light from the colour shifting element in order to modify the first optical effect to provide a second optical effect different from the first optical effect.

2. The method of claim 1, further comprising providing at least one internal polymer layer positioned between and overlapping with the first and second polymer layers, wherein each of any internal layer positioned between the colour shifting element and the first polymer layer comprise at least a region transparent to visible light such that the colour shifting element is viewable through the surface relief.

3. The method of claim 2, wherein the colour shifting element is provided on an internal layer.

4. The method of claim 1, wherein the joining step comprises a lamination process.

5. The method of claim 1, wherein the joining step comprises applying at least one of heat and pressure to the overlapping polymer layers.

6. The method of claim 1, wherein the joining step comprises applying pressure to the overlapping polymer layers by means of opposing pressure plates and an embossing structure corresponding to the surface relief, wherein during the joining step the embossing structure is in communication with the outwardly facing surface of the first polymer layer.

7. The method of claim 1, wherein the surface relief is formed in the outwardly facing surface of the first polymer layer by an embossing process.

8. The method of claim 1, further comprising providing an absorbing element positioned between the first and second polymer layers and on a distal side of the colour shifting element with respect to the first polymer layer, the absorbing element being adapted to at least partially absorb light.

9. The method of claim 8, wherein the absorbing element defines indicia.

10. The method of claim 2, comprising providing an opaque internal layer positioned between the colour shifting element and the first polymer layer, the opaque internal layer comprising a window region transparent to visible light through which the colour shifting element is viewable.

11. The method of claim 1 wherein second polymer layer comprises a region transparent to visible light such that the colour shifting element is viewable through the second polymer layer and;

during the joining step, a second surface relief is formed in the outwardly facing surface of the second layer, the second surface relief being adapted to interact with light from the colour shifting element in order to modify the first optical effect.

12. The method of claim 1, wherein the method further comprises;

providing a second colour shifting element positioned on a distal side of the first colour shifting element with respect to the first polymer layer, and wherein the second polymer layer comprises a region transparent to visible light such that the second colour shifting element is viewable through the second polymer layer, and wherein;

during the joining step, a second surface relief is formed in the outwardly facing surface of the second layer, the second surface relief being adapted to interact with light from the second colour shifting element in order to modify an optical effect provided by the second colour shifting element.

13. The method of claim 1, wherein the second polymer layer comprises a viewing region transparent to visible light.

14. The method of claim 1, wherein the surface relief comprises a microprismatic structure, wherein the microprismatic structure comprises a plurality of microprisms.

15. The method of claim 14, wherein the microprismatic structure comprises an array of linear microprisms.

16. The method of claim 15, wherein the microprismatic structure comprises two or more arrays of linear microprisms, each linear microprism having a respective long axis, wherein the long axes of one array are angularly offset from the long axes of the other array.

17. The method of claim 14, wherein the microprismatic structure is either a one-dimensional microprismatic structure; or a two-dimensional microprismatic structure.

18. The method of claim 2, wherein thin film interference structure is a Bragg stack.

19. A method of forming a security sheet, comprising:

forming a polymer substrate according to the method of claim 1, and;

processing the polymer substrate in order to form the security sheet.

20. The method of claim 19, wherein the processing step comprises selectively modifying a part of the surface relief formed in the outwardly facing surface of the first polymer layer such that the modified part of the surface relief provides a different optical effect from the second optical effect.

21. A polymer substrate for a security sheet, the polymer substrate comprising:

a plurality of overlapping, self-supporting polymer layers joined together, the plurality of polymer layers comprising:

first and second outer layers each providing outwardly facing surfaces that define outwardly facing surfaces of the polymer substrate, and at least one internal layer positioned between the first and second outer layers, the at least one internal layer comprising a colour shifting element adapted to provide a first optical effect to a viewer, the colour shifting element comprising one of: a photonic crystal structure, a liquid crystal material, an interference pigment, a pearlescent pigment, a structured interference material, or a thin film interference structure;

wherein the first outer layer and each of any internal layer positioned between the colour shifting element and the first outer layer comprise at least a region transparent to visible light such that the colour shifting element is visible through a surface relief provided in the outwardly facing surface of the first outer layer, the surface relief being adapted to interact with light from the colour shifting element in order to modify the first optical effect to provide a second optical effect different from the first optical effect.

22. A document of value comprising a security sheet formed from the polymer substrate of claim 21.

* * * * *